US009073311B2

(12) United States Patent
Ikarashi

(10) Patent No.: US 9,073,311 B2
(45) Date of Patent: Jul. 7, 2015

(54) PRINTING APPARATUS AND PRINT CONTROL METHOD

(71) Applicant: CANON KABUSHIKI KAISHA, Tokyo (JP)

(72) Inventor: Yumi Ikarashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/039,022

(22) Filed: Sep. 27, 2013

(65) Prior Publication Data

US 2014/0104334 A1 Apr. 17, 2014

(30) Foreign Application Priority Data

Oct. 16, 2012 (JP) ..... 2012-229240

(51) Int. Cl.

*B41J 29/38* (2006.01)
*B41J 2/045* (2006.01)
*B41J 2/165* (2006.01)

(52) U.S. Cl.

CPC ..... *B41J 2/04541* (2013.01); *B41J 2/16526* (2013.01); *B41J 2/16585* (2013.01); *B41J 2002/16529* (2013.01)

(58) Field of Classification Search

USPC ..... 347/5, 9, 12, 16, 19, 35, 23
IPC ..... B41J 2029/393
See application file for complete search history.

(56) References Cited

U.S. PATENT DOCUMENTS

| | | | | |
|---|---|---|---|---|
| 5,659,342 | A * | 8/1997 | Lund et al. | 347/35 |
| 7,357,308 | B2 | 4/2008 | Matz | |
| 7,614,723 | B2 | 11/2009 | Hatayama | |
| 2004/0090487 | A1 | 5/2004 | Kanemura | |
| 2006/0055715 | A1 * | 3/2006 | Nakahara et al. | 347/5 |
| 2006/0109300 | A1 | 5/2006 | Tsuboi et al. | |
| 2008/0186341 | A1 | 8/2008 | Hirato | |
| 2011/0310152 | A1 | 12/2011 | Muro et al. | |

FOREIGN PATENT DOCUMENTS

| | | | |
|---|---|---|---|
| JP | 2006-76247 | A | 3/2006 |
| JP | 2007-1118 | A | 1/2007 |

* cited by examiner

*Primary Examiner* — Lam Nguyen
(74) *Attorney, Agent, or Firm* — Fitzpatrick, Cella, Harper & Scinto

(57) ABSTRACT

An embodiment of this invention is directed to increasing the number of printable images on a continuous sheet and throughput when printing an image in which images of different sizes coexist and are arranged. Upon printing plural images by using a full-line inkjet printhead while conveying the sheet, the time during which no ink is discharged between successive images is analyzed from inputted image data for each nozzle of the printhead. Based on the analysis result, it is determined whether preliminary discharge is necessary during printing of the plural images. If preliminary discharge is necessary, print data to be used by the printhead is generated by adding, to the image data, data for preliminary discharge. Ink is discharged from the printhead based on the generated print data.

8 Claims, 20 Drawing Sheets

PRINTING APPARATUS AND PRINT CONTROL METHOD

BACKGROUND OF THE INVENTION

1. Field of the Invention

The present invention relates to a printing apparatus and print control method and, particularly, to a printing apparatus including, for example, an inkjet full-line printhead and a print control method for the apparatus.

2. Description of the Related Art

Conventionally, an inkjet printing apparatus prints by using an ensemble of small nozzles for discharging an ink droplet to print. Since the nozzle opening of the printhead is very small, to uniformly discharge ink and satisfy the image quality, the inkjet printing apparatus needs to take a measure to, for example, perform preliminary discharge in every predetermined time so as not to dry the nozzle.

Further, the inkjet printing apparatus performs the following control when printing on a continuous print medium (sheet) such as roll paper by using a full-line printhead (to be referred to as a printhead hereinafter) having the same width as the sheet width. More specifically, a pattern for maintaining the image quality is inserted periodically or on a certain condition between images to be printed, thereby maintaining the printing quality (see Japanese Patent Laid-Open Nos. 2006-76247 and 2007-001118).

In actual image printing, not only images of the same size are continuously printed on a sheet, but also images of different sizes are printed in an order in which they coexist, depending on switching of a print job or the arrangement of image data in a print job. For example, there is a case where an image smaller than the sheet width sometimes coexists and is printed. In this case, depending on image printing conditions before and after the image, a portion of the full-line printhead that was used to print the image may be unnecessary for printing the image quality maintenance pattern.

However, in the related art, the pattern is printed for the entire printing width of the printhead even in this case in order to maintain the image quality of the printhead including a portion not used for image printing. Since the image quality maintenance pattern is periodically printed between printed images, the image quality maintenance pattern unnecessary as a printing result for the user is printed on a continuous sheet. This decreases the number of printable images on the continuous sheet. In addition, printing the image quality maintenance pattern decreases the actual printing throughput.

SUMMARY OF THE INVENTION

Accordingly, the present invention is conceived as a response to the above-described disadvantages of the conventional art.

For example, a printing apparatus and print control method according to this invention are capable of printing at high quality without decreasing the printing throughput even when printing a preliminary discharge pattern.

According to one aspect of the present invention, there is provided a printing apparatus which prints a plurality of images by discharging ink to a sheet by using a full-line printhead while conveying the sheet. The apparatus comprises: an input unit configured to input image data from a host apparatus; a determination unit configured to analyze, from the image data input by the input unit, for each of a plurality of nozzles included in the full-line printhead, a time during which no ink is discharged between images to be successively printed, and determine in accordance with a result of the analysis whether or not preliminary discharge is necessary during printing of the plurality of images; a generation unit configured to generate print data to be used by the full-line printhead by adding, to the image data, data for the preliminary discharge in a case where the determination unit determines that the preliminary discharge is necessary; and a control unit configured to control to print by the full-line printhead based on the print data generated by the generation unit.

According to another aspect of the present invention, there is provided a print control method in a printing apparatus which prints a plurality of images by discharging ink to a sheet by using a full-line printhead while conveying the sheet. The method comprises: inputting image data from a host apparatus; analyzing, from the input image data, for each of a plurality of nozzles included in the full-line printhead, a time during which no ink is discharged between images to be successively printed, and determining in accordance with a result of the analysis whether or not preliminary discharge is necessary during printing of the plurality of images; generating print data to be used by the full-line printhead by adding, to the image data, data for the preliminary discharge in a case where it is determined that the preliminary discharge is necessary; and controlling to discharge ink from the full-line printhead based on the generated print data.

The invention is particularly advantageous since the image quality can be maintained while increasing the printing throughput, by minimizing preliminary discharge while effectively using a sheet when printing a plurality of images different in image width by using a full-line printhead.

Further features of the present invention will become apparent from the following description of exemplary embodiments (with reference to the attached drawings).

DESCRIPTION OF THE EMBODIMENTS

Figure 1:
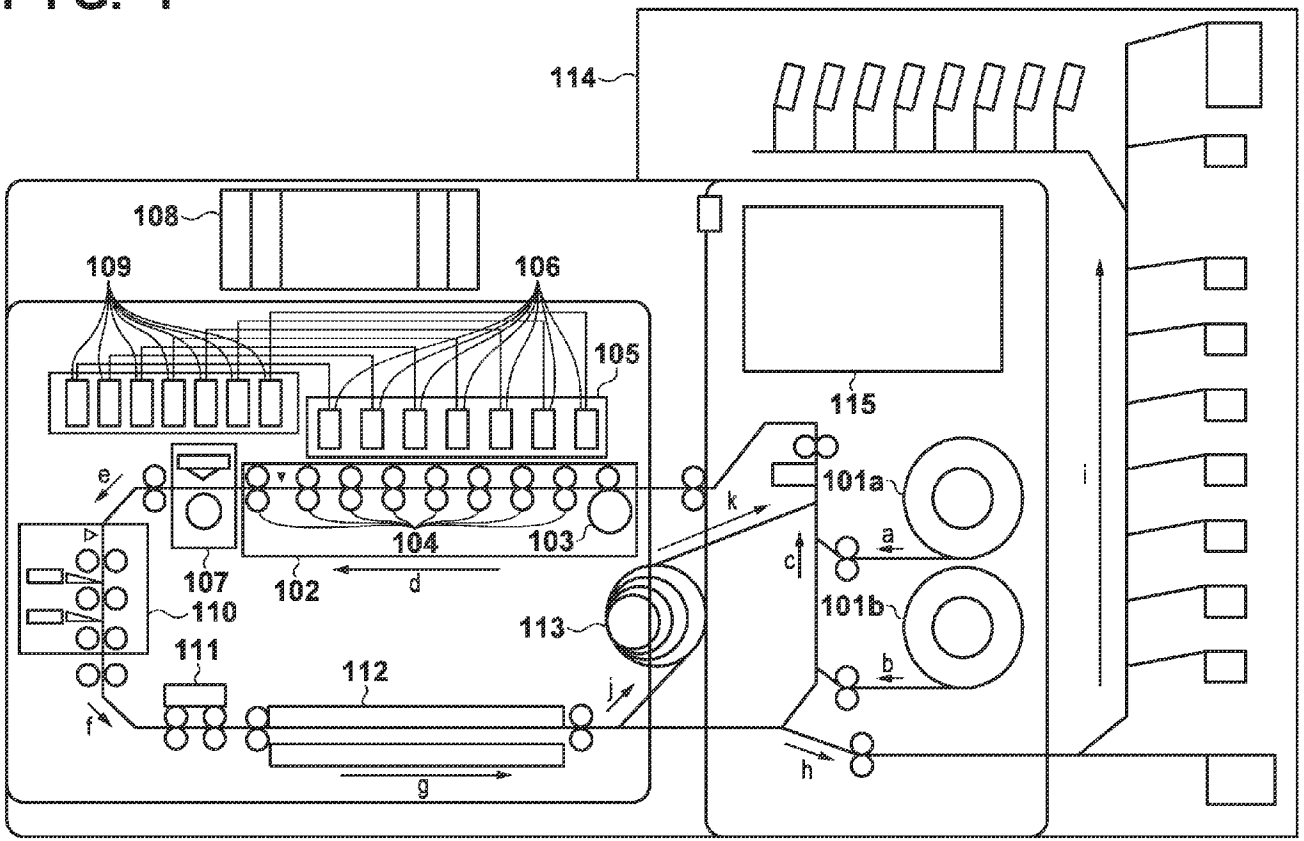
FIG. 1 is a side sectional view showing the schematic internal arrangement of an inkjet printing apparatus using a roll sheet as a print medium, as an exemplary embodiment.

Exemplary embodiments of the present invention will now be described in detail in accordance with the accompanying drawings. Note that the same reference numerals denote the same parts already described, and a description thereof will not be repeated.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink. The process of ink includes, for example, solidifying or insolubilizing a coloring agent contained in ink applied to the print medium.

Further, a "nozzle" generically means an ink orifice or a liquid channel communicating with it, and an element for generating energy used to discharge ink, unless otherwise specified.

A printhead substrate (head substrate) used below means not merely a base made of a silicon semiconductor, but an arrangement in which elements, wiring lines, and the like are arranged.

Further, "on the substrate" means not merely "on an element substrate", but even "the surface of the element substrate" and "inside the element substrate near the surface". In the present invention, "built-in" means not merely arranging respective elements as separate members on the base surface, but integrally forming and manufacturing respective elements on an element substrate by a semiconductor circuit manufacturing process or the like.

Next, an embodiment of an inkjet printing apparatus will be explained. The printing apparatus is a high-speed line printer which uses a rolled continuous sheet (print medium) and copes with both single-sided printing and double-sided printing. For example, the printing apparatus is suitable for the field of large-volume printing in a printing laboratory and the like.

FIG. 1 is a side sectional view showing the schematic internal arrangement of an inkjet printing apparatus (to be referred to as a printing apparatus hereinafter) using a roll sheet as a print medium, as an exemplary embodiment.

Although FIG. 1 shows only an apparatus arrangement having only the print function, the printing apparatus may function as a multi-function printer further having the scanner function of reading an image on an original, the facsimile function, and the like.

FIG. 1 exemplifies a printing apparatus using a roll sheet as a print medium. However, the print medium is not limited to the rolled form as long as it is a long continuous sheet which allows continuously printing a plurality of pages on the same surface without interrupting the printing. The continuous sheet may be cut automatically by the printing apparatus or by the user based on a manual instruction. The printing apparatus may be a printing apparatus capable of printing not only on a continuous sheet, but also on a cut sheet of a predetermined size.

The print medium is not limited to paper, and various printable media are usable, as described above.

The printing method is not limited to the inkjet method using a liquid ink. As the printing material, a solid ink may be used. Also, various methods are available, including an electrophotographic method using toner and a sublimation method. The printing apparatus is not limited to color printing using printing materials of a plurality of colors, but may perform monochrome printing using only a black (including gray) printing material.

When a printing operation in the printing apparatus is controlled in accordance with an instruction from an external apparatus connected to the printing apparatus shown in FIG. 1, this external apparatus serves as a print control apparatus.

The printing apparatus shown in FIG. 1 includes the following building components 101 to 115, which are arranged in one housing. However, these building components may be separately arranged in a plurality of housings. The control unit 108 integrates a controller (including a CPU or MPU), a user interface information output unit (generator for display information, audible information, and the like), and a control portion provided with various I/O interfaces. The control unit 108 performs various control operations of the overall printing apparatus.

The printing apparatus includes, as roll sheet units, two, upper sheet cassette 101*a* and lower sheet cassette 101*b*. The user mounts a roll sheet (to be referred to as a sheet hereinafter) in a magazine and then loads it into the printing apparatus main body. A sheet pulled out from the upper sheet cassette 101*a* is conveyed in the a direction in FIG. 1, and a sheet pulled out from the lower sheet cassette 101*b* is conveyed in the b direction in FIG. 1. The sheet from either cassette travels in the c direction in FIG. 1 and reaches the conveyance unit 102. The conveyance unit 102 conveys the sheet in the d direction (horizontal direction) in FIG. 1 during print processing via a plurality of rotating rollers 104. When switching the feed source sheet cassette from one to the other, an already pulled-out sheet is rewound into the cassette, and then a sheet is newly fed from a cassette in which the sheet to be newly fed is set.

The head unit 105 is arranged above the conveyance unit 102 to face the conveyance unit 102. In the head unit 105, the independent printheads 106 for a plurality of colors (seven colors in this embodiment) are held in the sheet conveyance direction. In this example, the head unit 105 includes seven printheads corresponding to seven, C (Cyan), M (Magenta), Y (Yellow), LC (Light Cyan), LM (Light Magenta), G (Gray), and K (blacK). Needless to say, other colors may be used, or all these colors may not be used. The printing apparatus forms an image on a sheet by discharging ink from the printhead 106 in synchronism with conveyance of the sheet by the conveyance unit 102.

Note that the printhead 106 is arranged at a position where the ink discharge destination does not overlap the rotating roller 104 in the sheet conveyance direction. Instead of directly discharging ink onto a sheet, the ink may be applied to an intermediate transfer member and then applied to a sheet, thereby forming an image. A printing unit is formed from the conveyance unit 102, head unit 105, and printheads 106.

The ink tanks 109 independently store inks of the respective colors. The inks are supplied from the ink tanks 109 via tubes to sub-tanks arranged in correspondence with the respective colors. The inks are then supplied from the sub-tanks to the printheads 106 via tubes. As the printheads 106, full-line printheads for the respective colors (seven colors in this embodiment) are provided in the d direction serving as the conveyance direction in printing. The full-line printhead corresponding to each color ink may be formed from a single seamless nozzle chip, or configured by arranging divided nozzle chips regularly in line or in a staggered array.

The embodiment uses a so-called full-line printhead in which nozzles are arranged in a range where they cover the width of the printing area of a sheet of a maximum size usable in the printing apparatus. The inkjet method of discharging ink from a nozzle can employ a method using a heater element, a method using a piezoelectric element, a method using an electrostatic element, a method using a MEMS element, and the like. Based on image data, ink is discharged from the nozzles of each full-line printhead (to be referred to as a printhead hereinafter). The discharge timing is decided based on an output signal from the conveyance encoder 103.

After an image is formed on the sheet, the sheet is conveyed from the conveyance unit 102 to the scanner unit 107. The scanner unit 107 optically reads a printed image or special pattern on a sheet to confirm whether or not the printed image has a deficiency, and confirm the state of the printing apparatus including the ink discharge state. As the image confirmation method, a method of confirming the ink discharge state by reading a pattern for checking the printhead state may be employed, or a method of confirming whether or not printing is successful comparing with an original image may be employed. Thus, the confirmation method can be appropriately selected from various methods.

The sheet is conveyed from the vicinity of the scanner unit 107 in the e direction and introduced into the cutter unit 110. The cutter unit 110 cuts the sheet at a length of a predetermined printing unit. The length of the predetermined printing unit changes depending on the size of an image to be printed. For example, the length in the conveyance direction is 135 mm for an L-size photograph, and 297 mm for the A4 size.

In single-sided printing, the cutter unit 110 cuts the sheet into a page. Depending on the contents of a print job, the cutter unit 110 may not cut the sheet into a page. In double-sided printing, the cutter unit 110 does not cut the sheet into a page for the first surface (for example, obverse surface) of the sheet, and images are continuously printed by a predetermined length. After an image is printed on the second surface (for example, reverse surface), the cutter unit 110 cuts the sheet into a page. The cutter unit 110 is not limited to a unit configured to cut a sheet for an image of one cut sheet in single-sided printing or reverse surface printing of double-sided printing. The cutter unit 110 may be a unit configured not to cut a sheet until the sheet is conveyed by a predetermined length, and cut it after the sheet is conveyed by the predetermined length. In this case, the sheet may be cut into an image of one cut sheet (one page) by a manual operation or the like using another cutter device. If cutting is required in the conveyance direction of the sheet, the sheet is cut using another cutter device.

The sheet conveyed from the cutter unit 110 is conveyed through the unit in the f direction in FIG. 1, and reaches the reverse surface printing unit 111. The reverse surface printing unit 111 is a unit configured to print predetermined information on the reverse surface of a sheet when printing an image on only one surface of the sheet. The information to be printed on the reverse surface of a sheet includes information (for example, order management number) such as a character, sign, and code corresponding to each printed image. When the printhead 106 prints an image for a print job of double-sided printing, the reverse surface printing unit 111 prints information as described above in an area other than the one where the printhead 106 prints an image. The reverse surface printing unit 111 can adopt a printing method such as application of a printing material, thermal transfer, or inkjet printing.

The sheet having passed through the reverse surface printing unit 111 is then conveyed to the drying unit 112. The drying unit 112 is a unit configured to heat, by warm air (heated gas (air)), a sheet passing through the unit in the g direction in FIG. 1, in order to dry an ink-applied sheet within a short period of time. Instead of using warm air, the drying method can employ various approaches such as cold air, warm-up by a heater, air drying by only standing, and irradiation with an electromagnetic wave such as ultraviolet light. Sheets each cut into the printing unit length pass one by one through the drying unit 112, are conveyed in the h direction in FIG. 1, and reach the sorting unit 114.

The sorting unit 114 holds a plurality of trays (18 trays in this embodiment), and determines a sheet discharge destination tray in accordance with the printing unit length or the like. A tray number is assigned to each tray. The sorting unit 114 discharges a sheet passing through the unit in the i direction in FIG. 1 to a tray corresponding to a tray number set for each printed image while confirming, by a sensor arranged on each tray, whether the tray has room or is full of sheets. As the tray serving as the discharge destination of a cut sheet, for example, a specific tray is designated by a print job issuing source (host apparatus), or a vacant tray is arbitrarily designated on the printing apparatus side.

A predetermined number of sheets are dischargeable to one tray. For a print job for which the number of sheets exceeds the predetermined value, sheets are discharged to a plurality of trays. The number, size, type, and the like of sheets dischargeable to a tray change depending on the size (type) of the tray or the like.

In FIG. 1, sheets of large sizes (larger than the L size, such as A4 size), and sheets of a small size (L size) are dischargeable to trays (to be referred to as large trays hereinafter) arranged in the longitudinal (vertical) direction. Sheets of a small size (L size) are dischargeable to trays (to be referred to as small trays hereinafter) arranged in the lateral (horizontal) direction, but sheets of large sizes cannot be discharged to them. The number of dischargeable output sheets is larger on the large tray than on the small tray. A state such as sheet discharge in progress or the completion of discharge is represented to be identifiable by the user by using, for example, a display such as an LED. For example, the respective trays are equipped with a plurality of LEDs which emit beams in different colors, and can notify the user of various states of the respective trays by the colors, lighting states, or flashing states of ON LEDs.

These trays can be prioritized. When executing a print job, the printing apparatus assigns vacant (no sheet exists) trays as sheet discharge destinations in the order of priority. As a default setting, the priority is higher for an upper one of the large trays and for a leftward one of the small trays. The priority is higher for the small tray than the large tray. This priority can be appropriately changed by a user operation or the like though the priority is set to be high for a position where the user can easily take out sheets.

The sheet take-up unit 113 takes up a sheet whose obverse surface has been printed without cutting the sheet into each page. In double-sided printing, first, a sheet having undergone image printing on the obverse surface is not cut into each page by the cutter unit 110, but is cut after the end of printing on the continuous obverse surface. The sheet having the printed obverse surface passes through the unit in the j direction in FIG. 1, and is taken up by the sheet take-up unit 113. The sheet taken up after the end of image printing on the obverse surface for a series of pages is conveyed again in the k direction in FIG. 1 after setting a surface opposite to the previous obverse surface as a printable surface, that is, turning over the surface to face the printhead 106. By this conveyance, image printing is performed on the reverse surface opposite to the previous obverse surface. In normal single-sided printing, a sheet on which an image has been printed is conveyed to the sorting unit 114 without taking up the sheet by the sheet take-up unit 113.

In double-sided printing, a sheet is taken up using the sheet take-up unit 113 to turn over the sheet and print on the reverse surface. For this reason, the surface of a sheet to be discharged to the sorting unit 114 is different between single-sided printing and double-sided printing. More specifically, in single-sided printing, turnover of a sheet using the sheet take-up unit 113 is not performed. A sheet on which an image of the first page has been printed is discharged with the image of the first page facing down. When one print job is a job including a plurality of pages, sheets are discharged to the tray from a sheet of the first page, and discharged sequentially from succeeding pages and stacked. This discharge is called face-down discharge.

In double-sided printing, turnover of a sheet using the sheet take-up unit 113 is performed. A sheet on which an image of the first page has been printed is discharged with the image of the first page facing up. When one print job is a job to output a plurality of sheets, sheets are discharged to the tray from a sheet containing the final page, and then discharged sequentially to preceding pages and stacked. Finally, a sheet on which an image of the first page has been printed is discharged. This discharge is called face-up discharge.

The operation unit 115 is a unit configured to allow the user to perform various operations, and notify him of various kinds of information. For example, the operation unit 115 allows the user to confirm a tray which has received a sheet on which an image designated by him has been printed, or the printing status of each order such as whether the image is being printed or has been printed. Also, the user can operate/confirm the operation unit 115 to check various states of the apparatus such as the ink residual amount and sheet residual amount, and issue an instruction to execute maintenance of the apparatus such as head cleaning.

Figure 2:
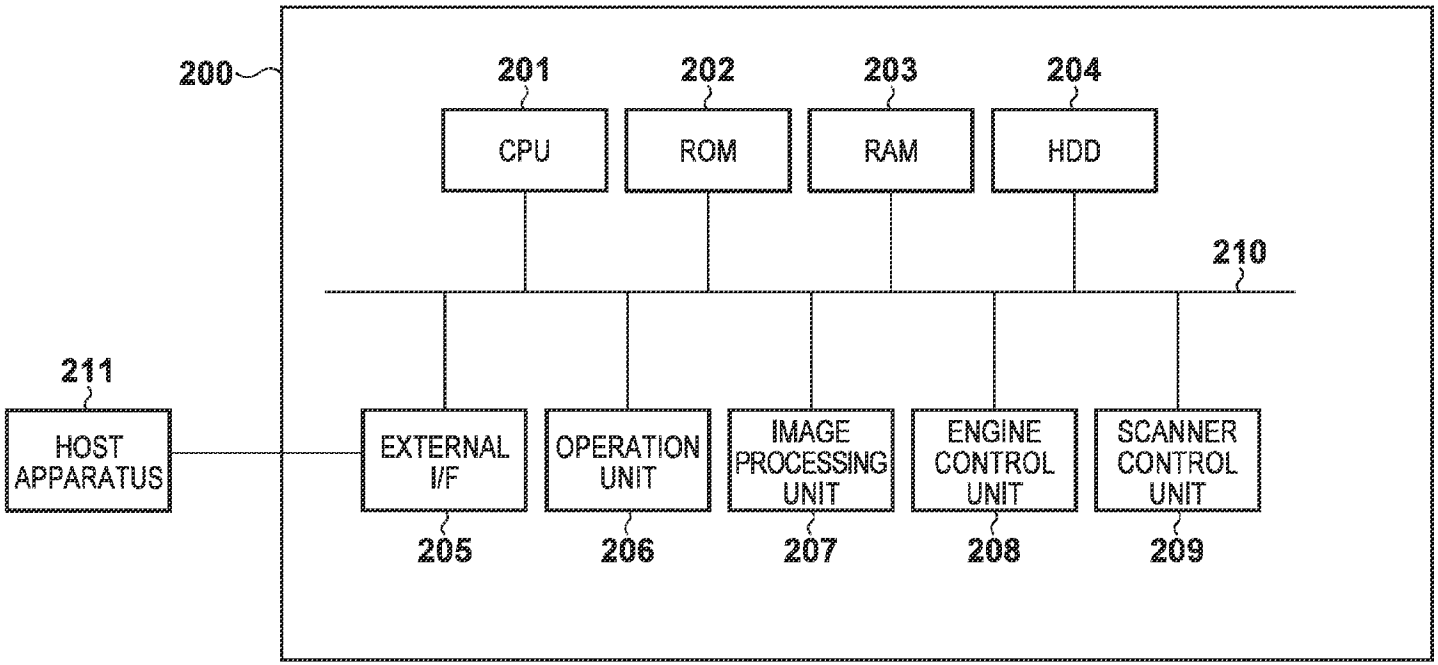
FIG. 2 is a block diagram showing the control arrangement of the printing apparatus shown in FIG. 1.

FIG. 2 is a block diagram showing a control arrangement in the printing apparatus shown in FIG. 1. In FIG. 2, a printing apparatus 200 is the printing apparatus shown in FIG. 1.

As shown in FIG. 2, the control unit 108 mainly includes a CPU 201, ROM 202, RAM 203, image processing unit 207, engine control unit 208, and scanner control unit 209. An HDD 204, operation unit 206, external I/F 205, and the like are connected to the control unit 108 via a system bus 210.

The control unit 108 in FIG. 1 includes the CPU 201 in the form of a microprocessor (microcomputer). The CPU 201 controls the operation of the overall printing apparatus 200 in accordance with execution of a program or activation of hardware. The ROM 202 stores programs to be executed by the CPU 201, and permanent data necessary for various operations of the printing apparatus 200. The RAM 203 is used as a work area by the CPU 201, used as a temporary storage area for various received data, and stores various setting data. The HDD 204 allows writing and reading out programs to be executed by the CPU 201, image data, and setting information necessary for various operations of the printing apparatus 200. Instead of the HDD 204, another mass-storage device such as a solid-state drive (SSD) is usable.

The operation unit 206 includes hard keys and a touch panel for performing various operations by the user, and a display unit for presenting (noticing) various kinds of information to the user. The operation unit 206 corresponds to the operation unit 115 shown in FIG. 1. Information can also be presented to the user by outputting a sound (for example, buzzer or voice) based on audible information from a voice generator.

The image processing unit 207 performs interpretation of image data (for example, data described in PDL) handled in the printing apparatus 200, bitmapping (conversion) into bitmap data, and image processing. The image processing unit 207 converts a color space (for example, YCbCr) representing input image data into a standard RGB color space (for example, sRGB). If necessary, the image processing unit 207 performs various image processes for image data such as resolution conversion into the number of effective pixels (printable by the printing apparatus 200), image analysis, and image correction. The image data obtained by these image processes are stored in the RAM 203 or HDD 204.

In accordance with a control command received from the CPU 201 or the like, the engine control unit 208 controls processing of printing an image based on image data on a sheet. More specifically, the engine control unit 208 executes an ink discharge instruction to the printhead 106 corresponding to each color ink, discharge timing setting for adjusting a dot position (ink landing position) on a print medium, adjustment based on acquisition of a head driving state, and the like. Further, the engine control unit 208 controls to drive the printhead in accordance with image data and discharge ink from the printhead, thereby forming an image on a sheet. Further, the engine control unit 208 controls the conveyance roller by, for example, issuing a feed roller driving instruction or conveyance roller driving instruction, or acquiring the rotating status of the conveyance roller. The engine control unit 208 causes the conveyance roller to convey a sheet at a proper speed on a proper path and stop the conveyance roller.

The scanner control unit 209 controls an image sensor in accordance with a control command received from the CPU 201 or the like, reads an image on a sheet, acquires red (R), green (G), and blue (B) analog brightness data, and converts them into digital data. As the image sensor, a CCD image sensor, CMOS image sensor, or the like is available. The image sensor may be a linear image sensor or area image sensor. Also, the scanner control unit 209 instructs driving of the image sensor, acquires the status of the image sensor based on the driving, analyzes brightness data acquired from the image sensor, and detects a discharge failure of ink from the printhead 106 and the cutting position of a sheet. A sheet for which the scanner control unit 209 determines that an image has been printed correctly undergoes drying processing for ink on the sheet, and then is discharged to a designated tray of the sorting unit.

A host apparatus 211 is an apparatus which corresponds to the above-described external apparatus, is externally connected to the printing apparatus 200, and serves as an image data supply source for causing the printing apparatus 200 to print. The host apparatus 211 issues various print job orders.

The host apparatus 211 may be implemented as a general-purpose personal computer (PC) or may be another type of data supply apparatus. Another type of data supply apparatus is, for example, an image capture apparatus which captures an image to generate image data. Examples of the image capture apparatus are a reader (scanner) which reads an image on an original to generate image data, and a film scanner which reads a negative or positive film to generate image data. Other examples of the image capture apparatus are a digital camera which captures a still image to generate digital image data, and a digital video which captures a moving image to generate moving image data. A photo storage may be installed on a network, or a socket for inserting a detachable portable memory may be provided to the printing apparatus 200. In this case, an image file stored in the photo storage or portable memory is read out to generate and print image data.

In place of the general-purpose PC, various data supply apparatuses such as a printing apparatus-dedicated terminal are available. These data supply apparatuses may be building components of the printing apparatus or separate apparatuses connected to the outside of the printing apparatus. When the host apparatus 211 is a PC, an OS, application software for generating image data, and the printer driver of the printing apparatus 200 are installed in the storage device of the PC.

The printer driver controls the printing apparatus 200. Also, the printer driver converts image data supplied from application software into a format processible by the printing apparatus 200, thereby generating image data. The host apparatus 211 may convert image data into print data and then supply the print data to the printing apparatus 200. It is not indispensable to implement all the above-described processes by software, and some or all of these processes may be implemented by hardware. Image data, other commands, status signals, and the like supplied from the host apparatus 211 can be transmitted/received to/from the printing apparatus 200 via the external I/F 205. The external I/F 205 may be a local I/F or a network I/F. The external I/F 205 may be wire-connected to an external device or wirelessly connected to an external device.

The above-described building components in the printing apparatus 200 are connected via the system bus 210 and can communicate with each other.

In the above-described example, one CPU 201 controls all the building components in the printing apparatus 200 shown in FIG. 2, but another arrangement is also possible. For example, some functional blocks may separately include CPUs and be individually controlled by their CPUs. In accordance with a role partitioning other than the arrangement shown in FIG. 2, each functional block may be appropriately divided as an individual processing unit or control unit, or several functional blocks may be integrated. In this way, various configurations can be employed. A DMAC can also be used to read out data from the memory.

Figure 3:
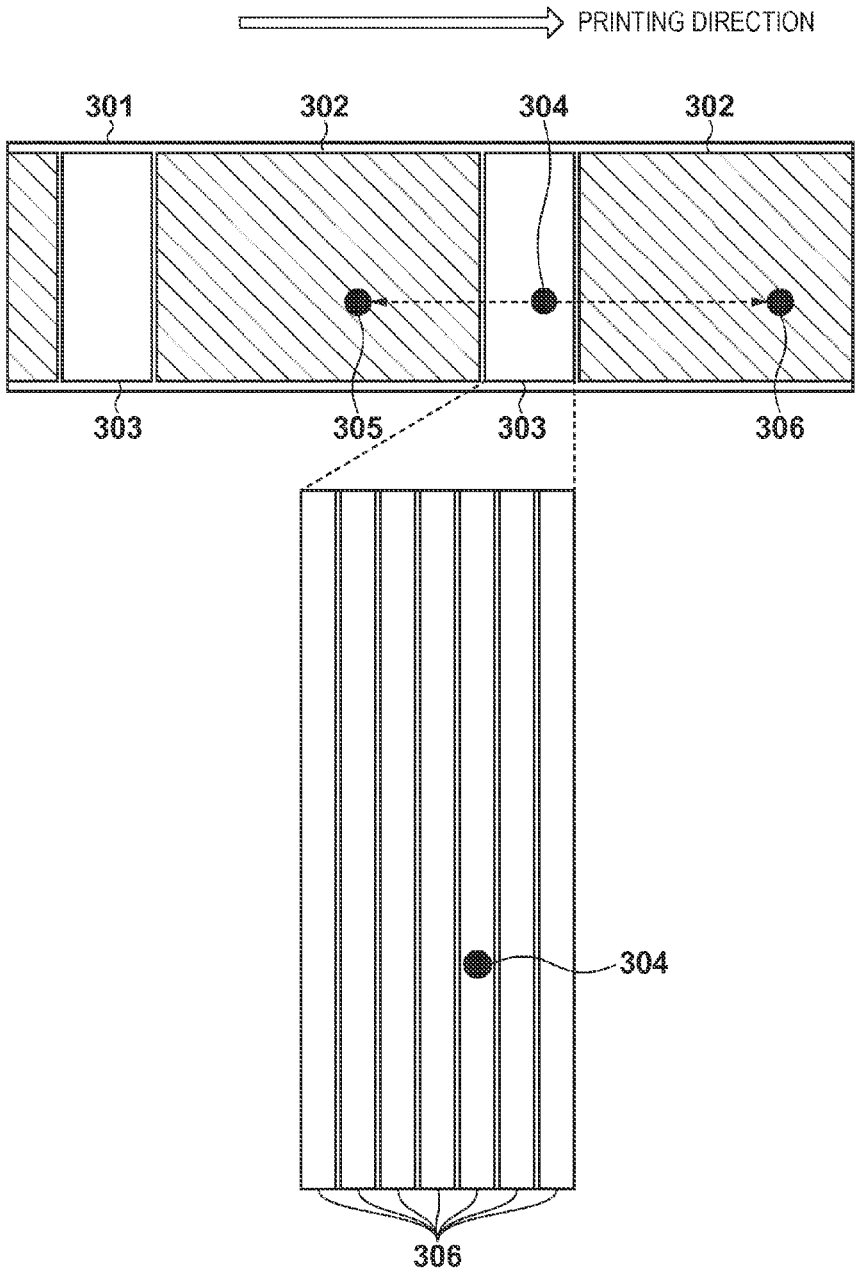
FIG. 3 is a view exemplifying an image printed on a sheet and a printing quality maintenance pattern.

FIG. 3 is a view exemplifying an image printed on a sheet and a printing quality maintenance pattern.

In this embodiment, when printing an image on a sheet, print data is generated by combining image data and data of the printing quality maintenance pattern, and printing is performed based on the print data. The structure and characteristic of the print data at this time will be explained.

FIG. 3 illustrates a state in which print data is printed on a sheet. As shown in FIG. 3, before printing on a sheet, the layout of an image to be printed by the printing apparatus is generated. FIG. 3 shows an example of the image layout. The data is generated to print an image having an arrangement as shown in FIG. 3 as the layout of print data (to be described later).

In FIG. 3, reference numeral 301 denotes a sheet which is processed to print by using the engine control unit 208 of the printing apparatus and the like; 302, a laid-out image to be printed on the sheet 301 by the engine control unit 208; and 303, a printing quality maintenance pattern (to be referred to as a preliminary discharge pattern hereinafter). The image arrangement shown in FIG. 3 is merely an example, and the image layout is determined in the image processing unit 207 or the like. In the example of FIG. 3, an image is printed at an image size equal to the width of the sheet 301.

As shown in FIG. 3, each preliminary discharge pattern 303 is laid out between the images 302. Printing of the preliminary discharge pattern is processing performed to maintain the printing quality before printing the next image because it is unknown whether or not the nozzles of all the printheads are used to print the image 302. As is apparent from FIG. 3, the preliminary discharge pattern 303 is laid out between the images 302. By printing the preliminary discharge pattern 303 every time one image 302 is printed, the state of the printhead can be reset to print the next image 302 at high quality.

Reference numerals 304, 305, and 306 denote pixels using the same nozzle. The pixel 304 represents one pixel of the preliminary discharge pattern, and the pixels 305 and 306 represent pixels in respective images. This example assumes that the nozzle used to print the pixels 304, 305, and 306 is not used between the pixels 304, 305, and 306. In this case, this nozzle is not used between the pixels 305 and 306 except for printing of the pixel 304 by preliminary discharge. For this reason, the printing quality becomes higher in a case in which the nozzle is used once to print the pixel 304 in printing of the preliminary discharge pattern and then the pixel 306 is printed, compared to a case in which the nozzle is used to print the pixel 305 and then the pixel 306 is printed without printing the pixel 304.

When the distance between the pixels 305 and 306 is long enough to satisfactorily maintain the printing quality without printing the pixel 304, the pixel 304 need not be printed by the preliminary discharge pattern. Depending on the state of the image 302, no preliminary discharge pattern need be arranged between images. Specific examples and effects of these cases will be described below.

Figure 4A:
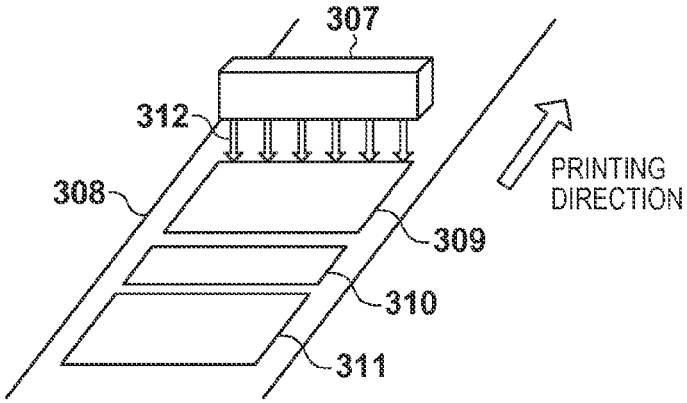
FIGS. 4A, 4B, and 4C are views each showing an example in which an image based print data described with reference to FIG. 3 is actually printed on a sheet.
Figure 4B:
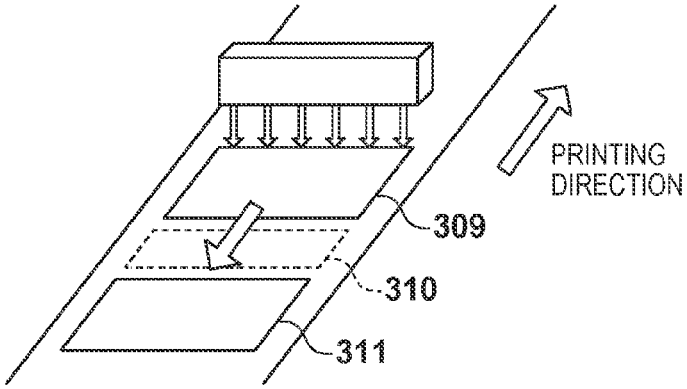
Figure 4C:
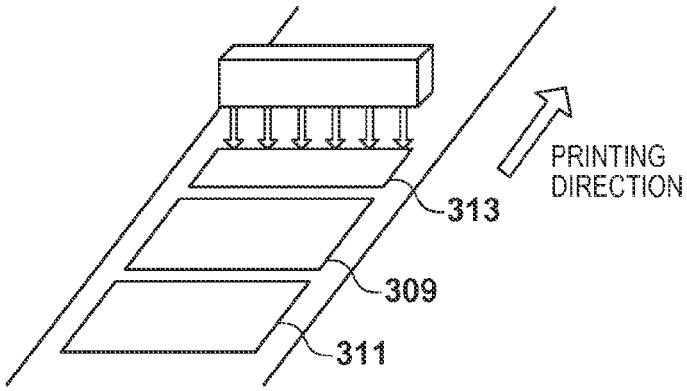

FIGS. 4A to 4C are views each showing an example in which the print data described with reference to FIG. 3 is actually printed on a sheet.

FIG. 4A shows a state in which images 309, 310, and 311 are printed by discharging ink 312 from a printhead 307 (corresponding to the head unit 105 in FIG. 1) to a sheet 308. In the state shown in FIG. 4A, the image 309 is printed by the discharged ink 312. From the relationship between FIG. 3 and FIGS. 4A to 4C, the images 309 and 311 correspond to the images 302, and the image 310 corresponds to the preliminary discharge pattern 303.

In this relationship, a case in which the preliminary discharge pattern 303 is not printed in FIG. 3 is equivalent to a case in which printing of the image 310 of the preliminary discharge pattern is skipped in FIG. 4A. That is, the image 309 is moved forward and printed next to the image 311, as shown in FIG. 4B. In the absence of the image 310 of the preliminary discharge pattern in FIG. 4A, printing of the image 309 has already ended, and printing advances to a next image 313, as shown in FIG. 4C.

Hence, as the number of preliminary discharge patterns decreases, the number of printable images increases and the number of images printed in the unit time also increases. In other words, reduction of the preliminary discharge pattern leads to a high printing throughput. Although the preliminary discharge pattern needs to be printed for higher image quality, this has a disadvantage in which the printing throughput decreases. It is therefore effective for a higher printing throughput to reduce printing of the preliminary discharge pattern in accordance with the situation.

<Print Processing>

1. General Outline

Figure 5:
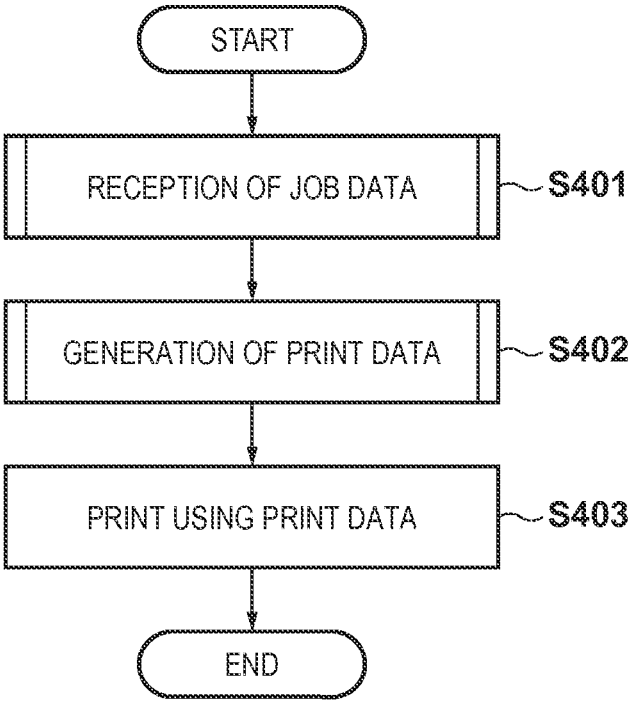
FIG. 5 is a flowchart showing an outline of print processing.

FIG. 5 is a flowchart showing an outline of print processing.

First, in step S401, the printing apparatus receives job data serving as print instruction data called a job from a connected PC or the like. Details of the job data reception will be explained later with reference to FIG. 6.

After receiving the job data, the printing apparatus generates print data in step S402. The attribute of the print job changes for each job. However, printing in this embodiment is printing on a continuous sheet, so it is necessary to rearrange image data of a job for printing on the continuous sheet, perform image processing, and then print. For this purpose, print data is generated based on the received job data. The preliminary discharge pattern shown in FIGS. 3 and 4A to 4C is arranged between images in the print data generation in step S402, details of which will be described later with reference to FIG. 7.

In step S403, the printing apparatus prints an image on the sheet based on the print data generated in step S402.

In this manner, the printing apparatus can continuously print a received job on a sheet.

2. Details of Job Data Reception

Figure 6:
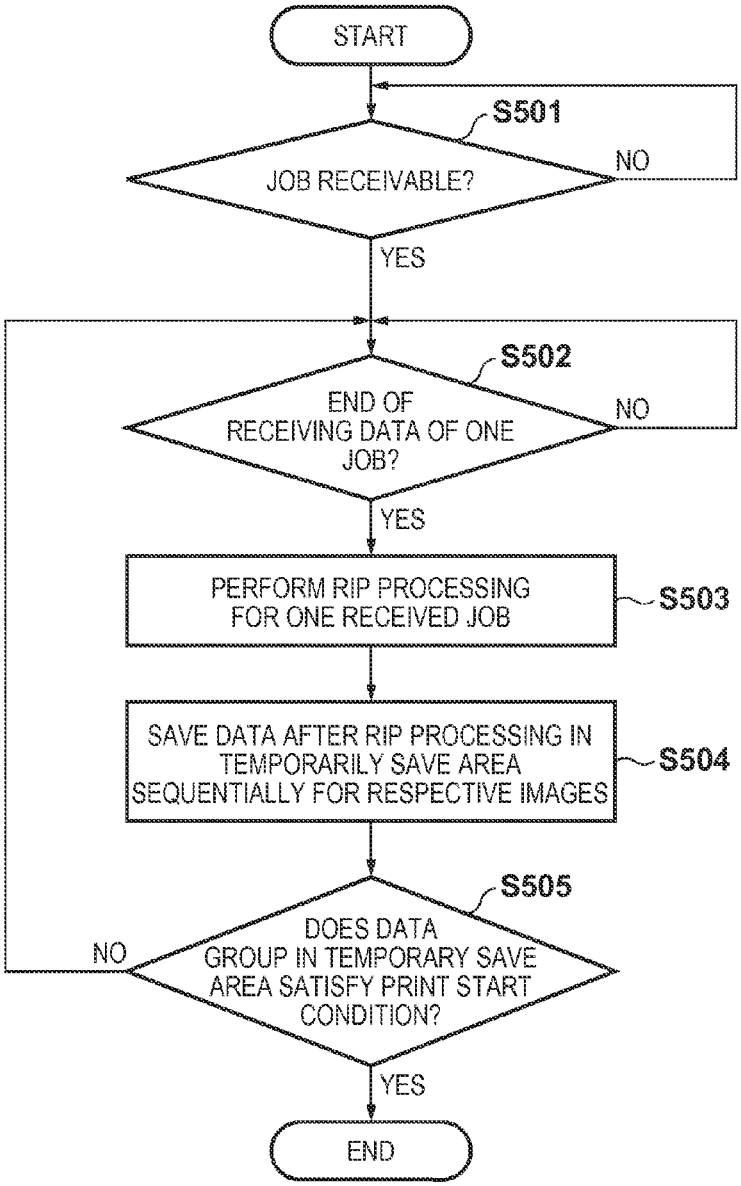
FIG. 6 is a flowchart showing detailed processing of job data reception in step S401 of FIG. 5.

FIG. 6 is a flowchart showing detailed processing of job data reception in step S401 of FIG. 5.

First, in step S501, it is confirmed whether or not the printing apparatus can receive a job. If the printing apparatus cannot receive a job, the process waits until the printing apparatus can receive a job. If the printing apparatus can receive a job, it automatically starts job reception. Since job reception is passive to the printing apparatus, the job reception step is not shown in FIG. 6. However, the printing apparatus performs job reception at this timing.

Then, in step S502, it is confirmed whether or not reception of data of one job has ended. The process waits until reception of data of one job has ended, and after the end of receiving data of one job is confirmed, advances to step S503. In step S503, RIP processing is executed for the received data of one job. By the RIP processing, image data contained in the job undergoes image processing. Here, images in the job are divided into respective images, which are used to print on a continuous sheet.

The process then advances to step S504 to save corresponding image data in a temporary save area for each image in an order in which the sheet is printed using the image data having undergone RIP processing. In this embodiment, the HDD 204 is partitioned to set and use a dedicated area as the temporary save area. However, another method may be used as long as the same purpose can be achieved.

In step S505, whether or not a print start condition is satisfied is checked based on information of the image data group saved in the temporary save area in step S504. In this embodiment, it is determined that the print start condition is satisfied when image data equivalent to the length of a prepared continuous sheet is saved in the temporary save area. However, if the print start condition is satisfied, as shown in this flowchart, the condition is not limited to this. If it is determined that the print start condition is not satisfied yet, the process returns to step S502. If it is determined that the print start condition is satisfied, the process ends.

After that, the process advances to the processing in step S402 shown in FIG. 5.

3. Details of Print Data Generation

Figure 7:
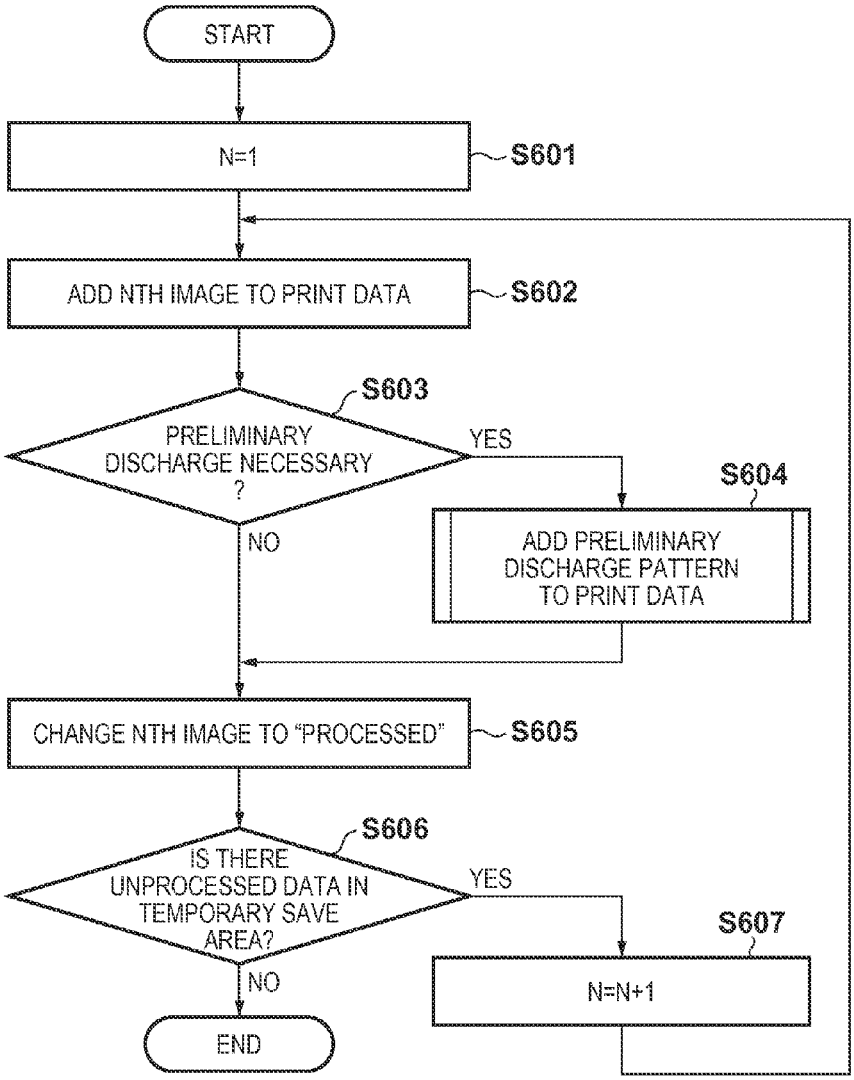
FIG. 7 is a flowchart showing detailed processing of print data generation in step S402 of FIG. 5.

FIG. 7 is a flowchart showing detailed processing of print data generation in step S402 of FIG. 5. As described with reference to FIG. 6, image data for printing is saved in the temporary save area. When the saved data amount satisfies the print start condition, the following processing is executed to generate print data.

First, in step S601, the number N of an image is initialized to be N=1. Then, in step S602, image data representing the Nth image in the temporary save area is added as print data. This addition means separately setting a save area and adding the print data to it. The print data is a data group assuming that the data are simply used for printing. After the image data representing the Nth image is added to the print data in step S602, the process advances to step S603 to confirm whether or not the preliminary discharge pattern is necessary after the image N.

The condition in this condition determination will be explained in detail later with reference to FIG. 8 or 10. If it is determined based on the condition shown in FIG. 8 or 10 that the preliminary discharge pattern needs to be printed, the process advances to step S604. In step S604, the preliminary discharge pattern is added to the print data. Addition of the preliminary discharge pattern will be explained in detail later with reference to FIG. 19.

In step S604, after image data corresponding to the image N is added to the print data, data of the preliminary discharge pattern is added in accordance with the result. After the addition, the process advances to step S605. If it is determined in step S603 that no preliminary discharge pattern need be printed, the process simply advances to step S605.

In step S605, a status on image data corresponding to the Nth image among image data saved in the temporary save area is changed to "processed". Information "before printing" or "processed" is added to image data saved in the temporary save area. This information is changed to "processed", representing that the image data has been used in print data.

In step S606, it is confirmed whether or not image data whose status is not "processed" exists among image data in the temporary save area. If image data "before processing" does not exist in the temporary save area, the process ends. If image data "before processing" exists, the process advances to step S607 to increment the N value by one, and returns to step S602.

In this fashion, image data saved in the temporary save area can be arranged in the print data, including the preliminary discharge pattern.

4. Determination of Whether Preliminary Discharge is Necessary or Unnecessary

Figure 8:
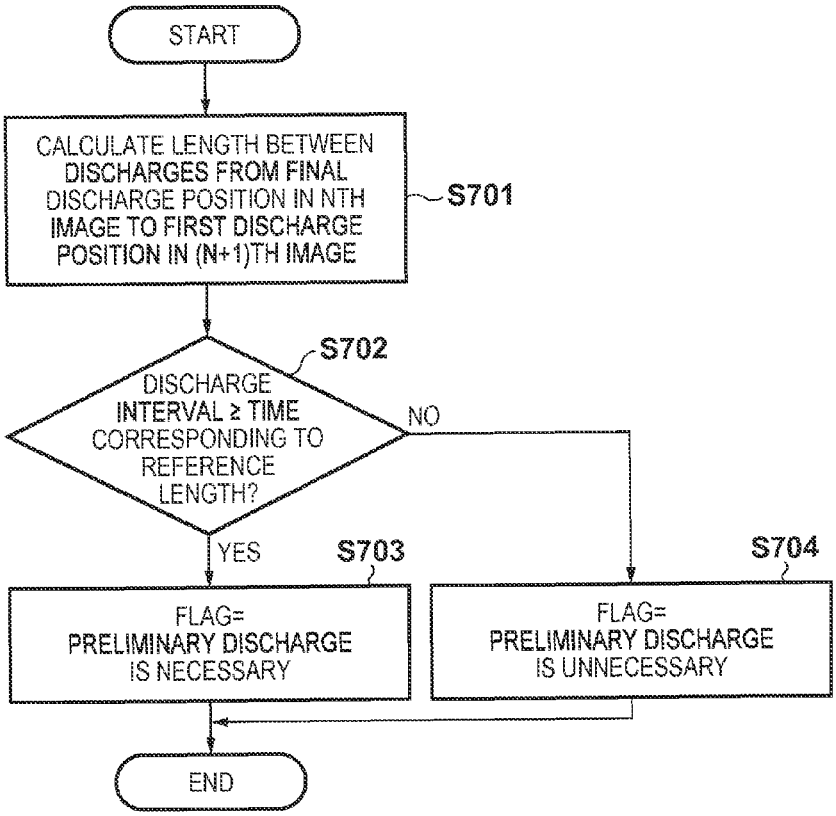
FIG. 8 is a flowchart showing processing of performing condition determination of whether printing of a discharge pattern for maintaining the image quality is necessary or unnecessary when printing each image.

FIG. 8 is a flowchart showing processing of performing determination of whether preliminary discharge for maintaining the image quality is necessary or unnecessary when printing each image by using all the nozzles. This flowchart shows details of the processing of determining the condition to determine in step S603 of FIG. 7 whether or not preliminary discharge is necessary. In this embodiment, the preliminary discharge necessity/unnecessity determination is performed for each nozzle of the printhead. In this description, N indicates the same image order as one mentioned in FIG. 7.

First, in step S701, a length, by which the nozzle is not used, from the position of a pixel to be discharged finally in the image N to the position of a pixel to be discharged for the first time in the image N+1 on a print medium to be printed in an actual printing operation is calculated. More specifically, the length between these pixels can be calculated from the coordinates of the pixel to be discharged finally in the image N and those of the pixel requiring discharge from this nozzle in the image N+1. This length corresponds to the interval between the pixels 305 and 306 illustrated in FIG. 3. The length is calculated on the premise that the preliminary discharge pattern is printed between images by using all the nozzles.

Then, in step S702, the length by which the nozzle is not used is compared with a reference value determined from the sheet conveyance speed. The reference value represents a length obtained by dividing the sheet conveyance speed by a predetermined time. The predetermined time is a predetermined time interval when discharge is performed in every predetermined time to prevent drying of the nozzle.

Figure 9A:
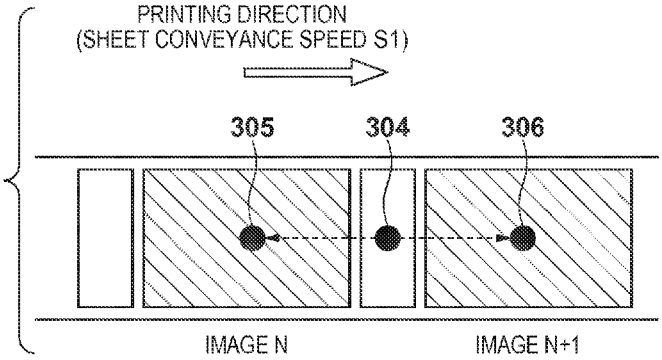
FIGS. 9A, 9B, and 9C are views for explaining a reference value.
Figure 9B:
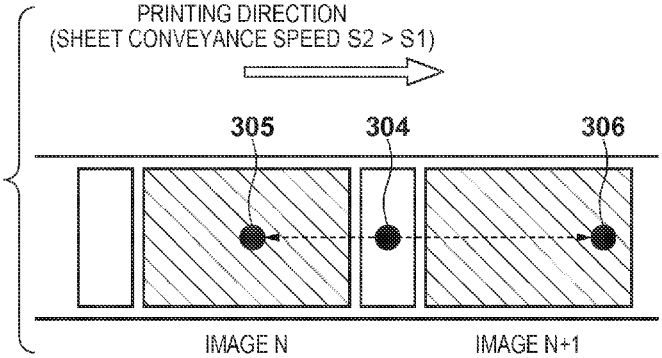
Figure 9C:
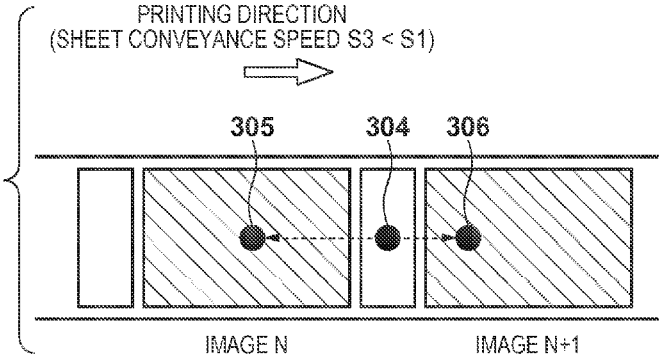

FIGS. 9A to 9C are views for explaining the reference value. In FIGS. 9A to 9C, the interval between the pixels 305 and 306 represents the length of the reference value determined by the sheet conveyance speed.

FIG. 9A shows a case in which the sheet conveyance speed is S1. When the sheet conveyance speed is S2 (>S1), as shown in FIG. 9B, the reference value becomes larger than the one shown in FIG. 9A. When the sheet conveyance speed is S3 (<S1), as shown in FIG. 9C, the reference value becomes smaller than the one shown in FIG. 9A.

As is apparent from a change of the reference value shown in FIGS. 9A to 9C, in step S702, if the printing interval between the pixels 305 and 306 is equal to or larger than a time corresponding to the reference length shown in FIG. 9A, no ink is discharged for a time longer than the time during which the nozzle dries. The process therefore advances to step S703 to determine that the nozzle requires preliminary discharge. To the contrary, if the interval between the pixels 305 and 306 is smaller than the length of the reference value shown in FIG. 9A, ink is discharged at a timing before the time length during which the nozzle dries. Hence, the process advances to step S704 to determine that the nozzle does not require preliminary discharge.

By the above-described processing, whether or not preliminary discharge is necessary after the image N is determined for all the nozzles.

In this manner, whether preliminary discharge is necessary or unnecessary is determined from a length corresponding to the time during which the nozzle is not used. Even if images of different sizes coexist and the printable position of the preliminary discharge pattern is indefinite, preliminary discharge can be performed appropriately and efficiently without exceeding the reference value.

Figure 10:
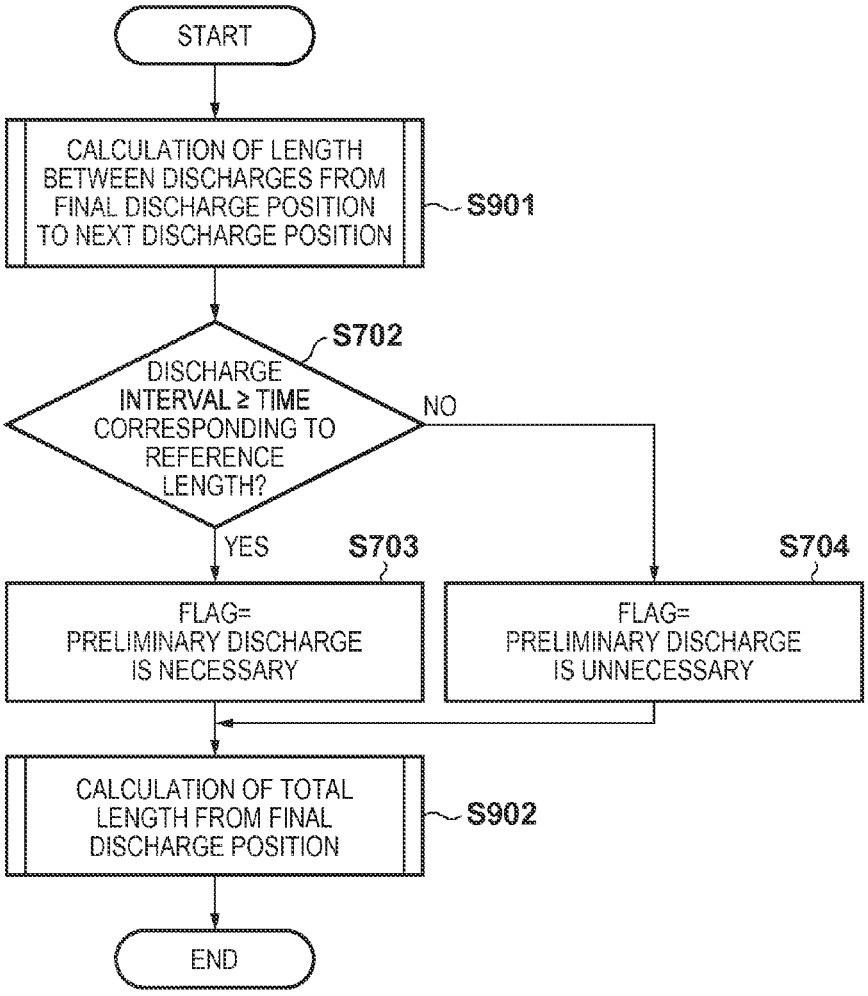
FIG. 10 is a flowchart showing details of processing of determining in step S603 of FIG. 7 whether or not preliminary discharge is necessary.

FIG. 10 is a flowchart showing condition determination processing of whether preliminary discharge for maintaining the image quality is necessary or unnecessary for each nozzle when there is a nozzle requiring no discharge operation in every image printing. This flowchart shows details of the processing of determining in step S603 of FIG. 7 whether or not preliminary discharge is necessary. In this embodiment, the preliminary discharge necessity/unnecessity condition determination is performed for each nozzle of the printhead. Also, in this description, N indicates the same image order as one mentioned in FIG. 7. In FIG. 10, the same step reference numerals as those described with reference to FIG. 8 denote the same processing steps, and a description thereof will not be repeated.

In step S901, a length, by which the nozzle is not used, from the final position of a pixel requiring discharge from the nozzle till printing of the image N to a position where discharge from the nozzle is necessary in the image N+1, on a print medium to be printed in an actual printing operation is calculated. This length calculation assumes that the preliminary discharge pattern is printed using all the nozzles after printing the image N. The total value of the length by which the nozzle is not used till the image N+1 is obtained.

The method of calculating a length by which the nozzle is not used will be explained with reference to the drawings.

Figure 11:
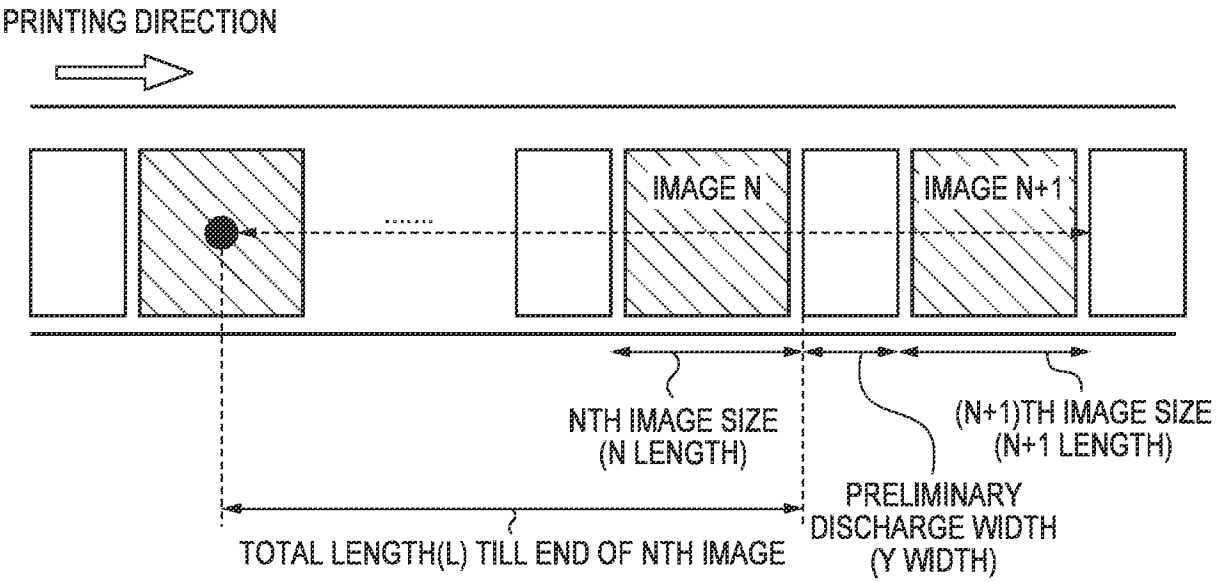
FIG. 11 is a view schematically showing calculation of the length corresponding to a time period during which the target nozzle is not used.

FIG. 11 is a view schematically showing calculation of the length corresponding to a time period during which the nozzle is not used.

In FIG. 11, the length of a side of the image N in the printing direction is defined as the N length, and the length of a side of the image N+1 in the printing direction is defined as the N+1 length. Also, the length of a side, in the printing direction, of a preliminary discharge pattern which is discharged between the images N and N+1 by using all the nozzles is defined as the Y width. The total value of a length by which the nozzle is not used till the end of the pixel of the image N in the printing direction is defined as L. The length is calculated using these four values. More specifically, the length between pixels can be calculated from the coordinates of the pixel to be discharged from the nozzle till printing of the image N, and those of the pixel requiring discharge from this nozzle in the image N+1. Note that details of the length calculation will be described with reference to FIGS. 12 to 15F.

After calculating the length by which the nozzle is not used, in step S702, the length obtained in step S901 is compared with a reference value determined from the sheet conveyance speed. In steps S702 to S704, whether preliminary discharge is necessary or unnecessary is determined in accordance with the comparison result.

After the preliminary discharge necessity/unnecessity determination, the process advances to step S902 to calculate a length by which the nozzle is not used in the Nth and subsequent images. In this case, the total value of a length by which the nozzle is not used till printing of the image N+1 is calculated, as needed. The result is stored in the temporary save area for every nozzle.

Details of the processing in step S902 will be described later with reference to FIG. 14.

According to the above-described method, when there is a nozzle requiring no discharge operation in every image, whether or not preliminary discharge is necessary after printing the image N is determined for all the nozzles.

Figure 12:
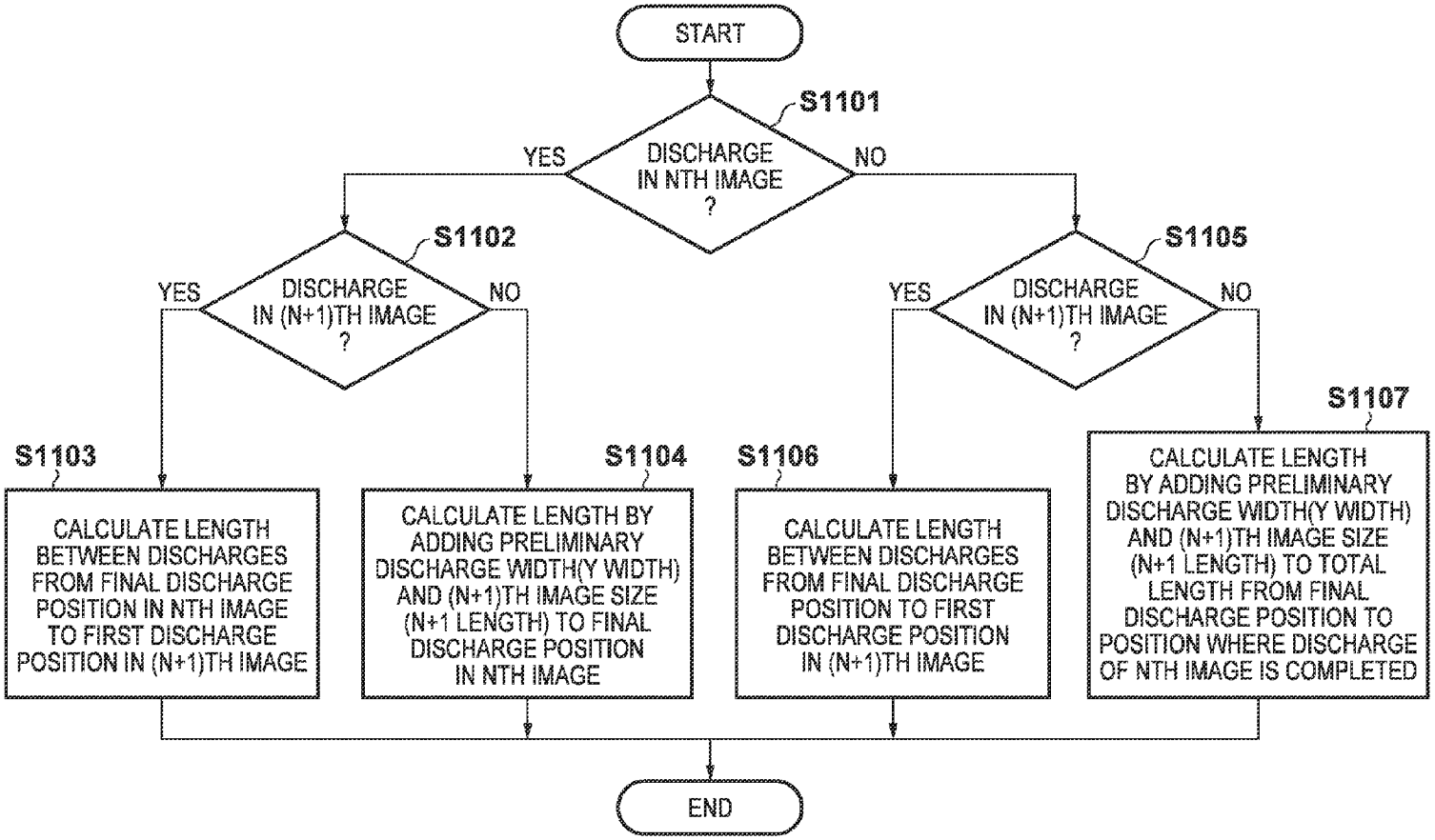
FIG. 12 is a flowchart showing details of processing in step S901 of FIG. 10.

FIG. 12 is a flowchart showing processing of calculating a length by which the nozzle is not used till the image N+1 before preliminary discharge necessity/unnecessity determination. This flowchart explains details of the processing in step S901 of FIG. 10. This processing obtains a length for determining whether or not the length exceeds the reference value even if the image N+1 is printed without preliminary discharge after printing the image N. This processing is executed for each nozzle. This length is a length including the Y width when printing the preliminary discharge pattern by using all the nozzles after printing the image N.

First, in step S1101, it is checked whether or not the target nozzle discharges ink in the image N. Then, in the next steps S1102 and S1105, whether or not to discharge ink in the image N+1 is checked regardless of the determination result in step S1101. Based on these two determination results, the length between two points by which the nozzle is not used is calculated in subsequent processing.

FIGS. 13A to 13D show examples of the length under various conditions.

If it is determined in step S1102 that there is an ink discharge in the image N+1, a pixel requiring ink discharge exists in both the images N and N+1. In this case, the process advances to step S1103 to calculate a length between discharges from the final discharge position in the image N to the first discharge position in the image N+1. This is the same processing as that in step S701 of FIG. 8.

Figure 13A:
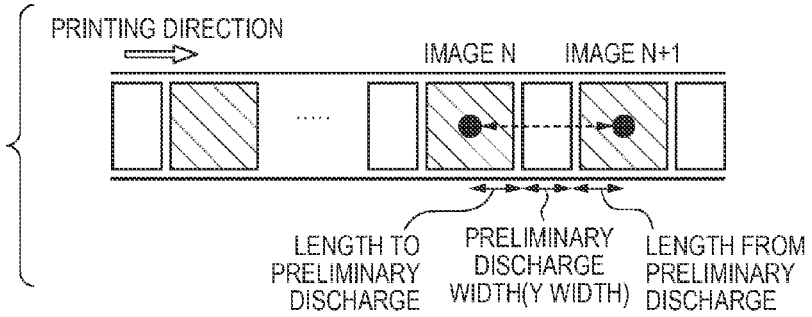
FIGS. 13A, 13B, 13C, and 13D are views showing examples of the length under various conditions.

FIG. 13A shows a length when a pixel requiring ink discharge exists in both the images N and N+1. The length in this case is calculated by adding three lengths, that is, a length from the final discharge position in the image N to the start position of the preliminary discharge pattern, the Y width, and a length from the end position of the preliminary discharge pattern to the first discharge position in the image N+1.

If it is determined in step S1102 that there is no ink discharge in the image N+1, ink is discharged in the image N and is not discharged in the image N+1. In this case, the process advances to step S1104 to calculate a length, by which the nozzle is not used, from the final discharge position in the image N to a position where all the pixels of the image N+1 are printed.

Figure 13B:
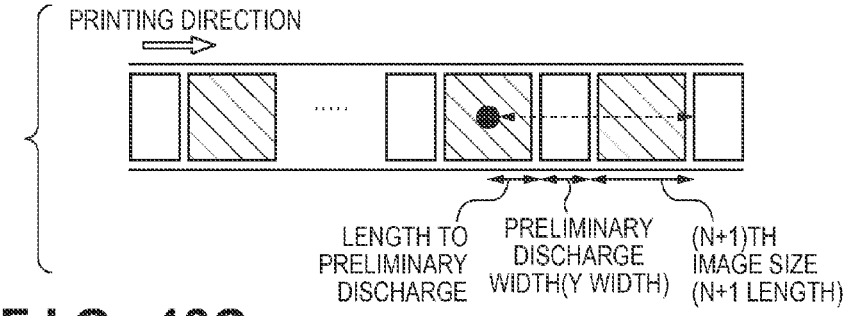

FIG. 13B shows a length when ink is discharged in the image N and is not discharged in the image N+1. The length in this case is calculated by adding three lengths, that is, a length from the final discharge position in the image N to the start position of the preliminary discharge pattern, the Y width, and the N+1 length.

If it is determined in step S1105 that there is an ink discharge in the image N+1, there is a pixel requiring no ink discharge in the image N and requiring ink discharge in the image N+1. In this case, the process advances to step S1106 to calculate a length between discharges by adding a length to the first discharge position in the image N+1 to the total value of a length by which the nozzle is not used till the end of the image N.

Figure 13C:
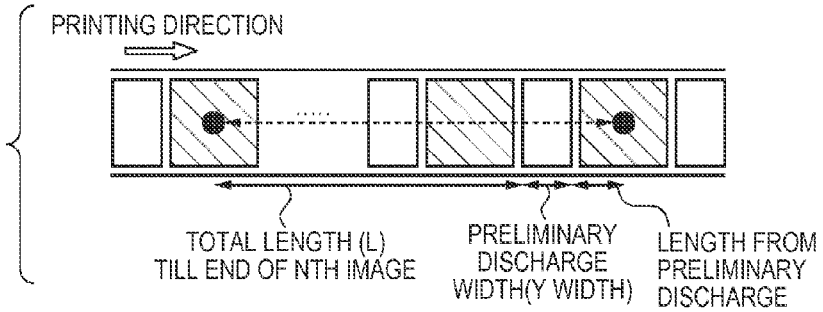

FIG. 13C shows a length when there is a pixel requiring no ink discharge in the image N and requiring ink discharge in the image N+1. The length in this case is calculated by adding three lengths, that is, the total length L by which the nozzle is not used till the end of the image N, the Y width, and a length from the end position of the preliminary discharge pattern to the first discharge position in the image N+1.

If it is determined in step S1105 that there is no ink discharge in the image N+1, no ink is discharged in both the images N and N+1. In this case, the process advances to step S1107 to calculate a length by which the nozzle is not used, by adding a length to a position where all the pixels of the image N+1 are printed, to the total value of a length by which the nozzle is not used till the end of the image N.

Figure 13D:
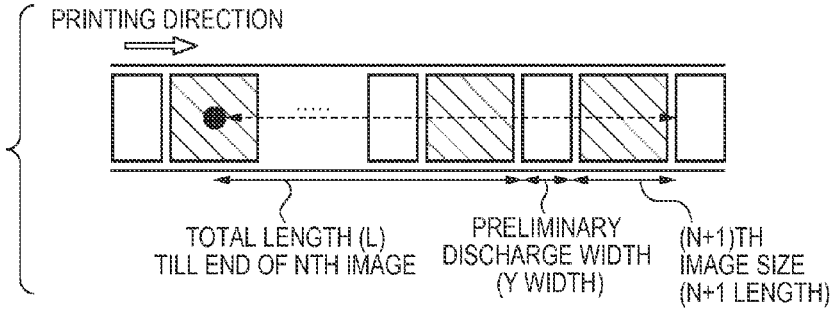

FIG. 13D shows a length when no ink is discharged in both the images N and N+1. The length in this case is calculated by adding three lengths, that is, the total length L by which the nozzle is not used till the end of the image N, the Y width, and the N+1 length.

In this way, a length to be compared with the reference value is obtained, and the processing in step S702 of FIG. 10 is executed.

Figure 14:
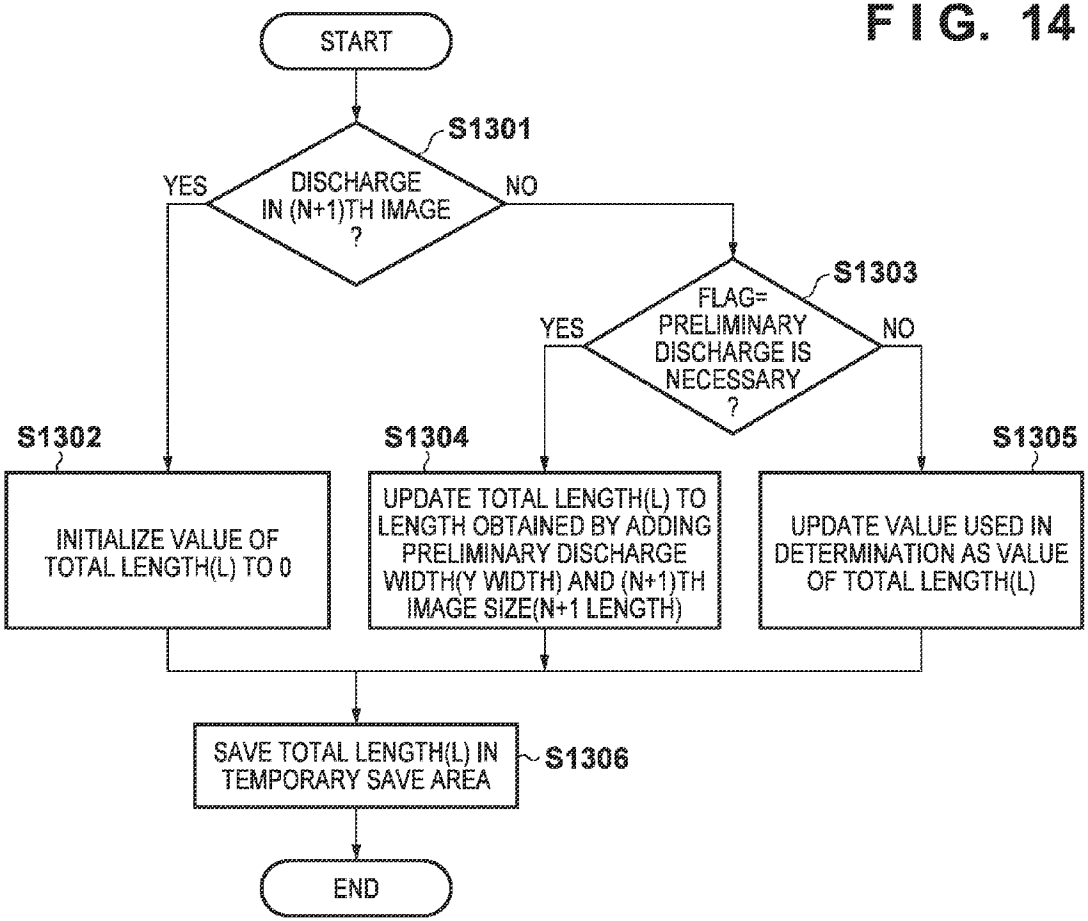
FIG. 14 is a flowchart showing details of processing in step S902 of FIG. 10.

FIG. 14 is a flowchart showing detailed processing which is executed after preliminary discharge necessity/unnecessity determination, in order to calculate a length by which the nozzle is not used till the end of the image N+1. This flowchart details step S902 of FIG. 10. This processing is performed to calculate a length by which the nozzle is not used in the Nth and subsequent images. This processing is executed for each nozzle to calculate, in consideration of the preliminary discharge determination result, a length by which the nozzle is not used till the end of the image N+1.

FIGS. 15A to 15F show examples of the length under various conditions. FIGS. 15A to 15F show specific examples of the total value L obtained by executing the processing shown in FIG. 14 under the respective conditions shown in FIGS. 13A to 13D.

In step S1301, it is checked whether or not the target nozzle discharges ink in the image N+1. If it is determined that the target nozzle discharges ink, a length required in preliminary discharge necessity/unnecessity determination after the image N+1 is a value for an area where printing is performed after the position of a pixel finally discharged in the image N+1. Hence, the total value of a length by which the nozzle is not used till the image N+1 after the image N is not required. In this case, the process advances to step S1302 to initialize the accumulated total value L to "0".

Figure 15A:
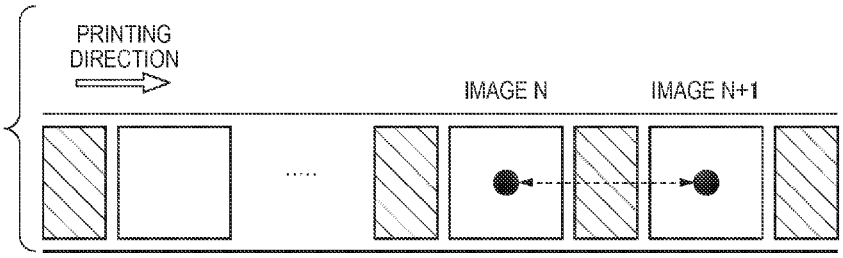
FIGS. 15A, 15B, 15C, 15D, 15E, and 15F are views showing examples of the length under various conditions.
Figure 15B:
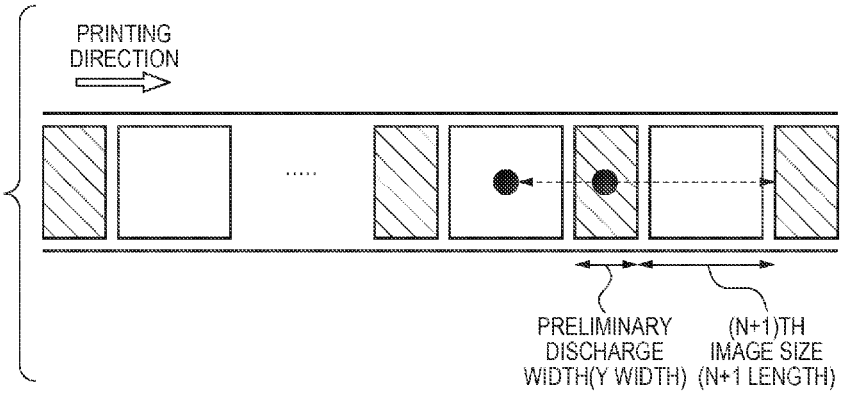
Figure 15C:
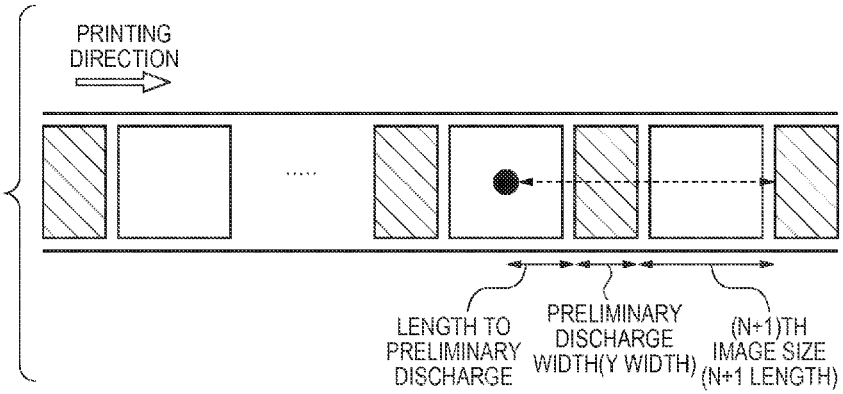
Figure 15D:
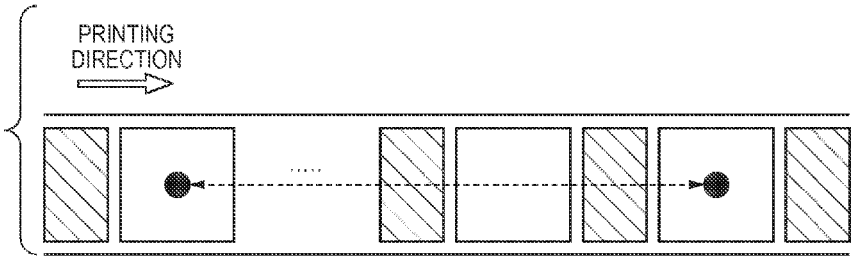

The case in which the process advances to step S1302 corresponds to the cases illustrated in FIGS. 13A and 13C, which correspond to cases illustrated in FIGS. 15A and 15D, respectively. As shown in FIGS. 15A and 15D, there is no value to be added to the total value L.

In contrast, if it is determined in step S1301 that the target nozzle does not discharge ink, the total value L of a length by which the nozzle is not used till the end of the image N+1 after the image N is required. Thus, the total value of a length by which the nozzle is not used till the end of the image N+1 is calculated in consideration of whether or not preliminary discharge is performed after printing the image N. In this case, the process advances to step S1303 to check, based on the processing results in steps S702 to S704 of FIG. 10, whether or not to perform preliminary discharge after printing the image N. If it is determined to perform preliminary discharge after printing the image N, the process advances to step S1304. If it is determined not to perform preliminary discharge after printing the image N, the process advances to step S1305.

Figure 15E:
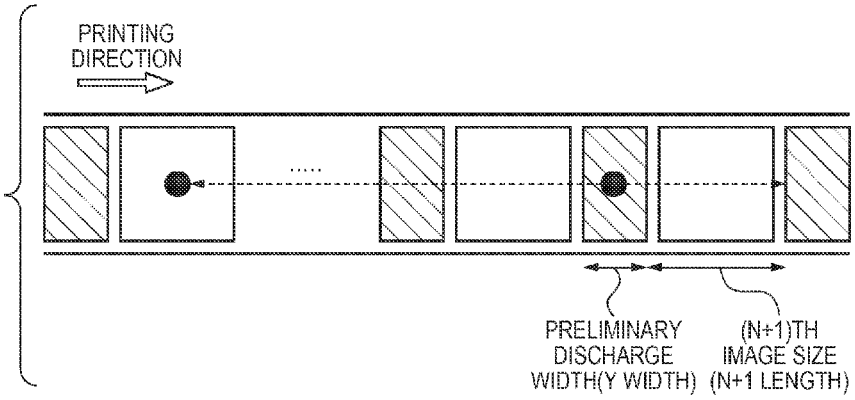

In step S1304, a length from a position where preliminary discharge is performed after printing the image N to a position where discharge of the image N+1 ends is obtained. A length from the start position where the preliminary discharge pattern is discharged, to the discharge end position of the image N+1 is calculated as the total value L of a length by which the nozzle is not used. The case in which the process advances to step S1304 corresponds to the case in which preliminary discharge is performed after printing the image N, as illustrated in FIGS. 13B and 13D, which correspond to cases illustrated in FIGS. 15B and 15E, respectively. As shown in FIGS. 15B and 15E, the final discharge position till printing of the image N+1 is the preliminary discharge pattern. Therefore, the Y width and the N+1 length serve as the total value L of a length by which the nozzle is not used till the end of the image N+1.

In step S1305, a length to the printing end position of the image N+1 is obtained from the total value of a length by which the nozzle is not used till the end of the image N. In this case, in the processing of FIG. 12, the length is calculated on the premise that no preliminary discharge is performed after printing the image N. The condition to perform the processing in step S1305 is satisfied. Therefore, the length obtained in the processing of FIG. 12 is used as the total value L of a length by which the nozzle is not used.

Figure 15F:
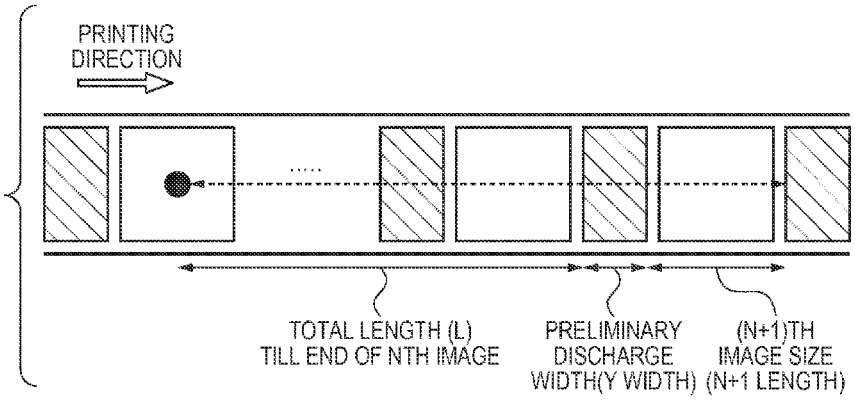

The case in which the process advances to step S1305 corresponds to the case in which no preliminary discharge is performed after printing the image N, as illustrated in FIGS. 13B and 13D, which correspond to cases illustrated in FIGS. 15C and 15F, respectively. As shown in FIGS. 15C and 15F, the length by which the nozzle is not used till the end of the image N+1 is equal to a length obtained in FIG. 13B or 13D. For this reason, the sum of three lengths, that is, the total length L by which the nozzle is not used till the end of the image N, the Y width, and the N+1 length serves as the total value L. Thus, the value in FIG. 12 is simply used as the total value L.

The finally calculated total value L is saved in the temporary save area in step S1306 to use it in calculation for the image N and subsequent images.

By the above-described processing, post-processing of preliminary discharge necessity/unnecessity determination (step S702) in FIG. 10 is performed, and a series of preliminary discharge necessity/unnecessity determination processes ends.

By the processing explained with reference to FIGS. 8 to 15F, whether preliminary discharge for each nozzle is necessary or unnecessary can be determined from a length by which the nozzle is not used.

Next, an example in which the preliminary discharge pattern can be shortened in the sheet conveyance direction in accordance with the result of determining in FIGS. 8 to 15F whether preliminary discharge is necessary or unnecessary will be explained with reference to FIGS. 16 to 18.

Figure 16:
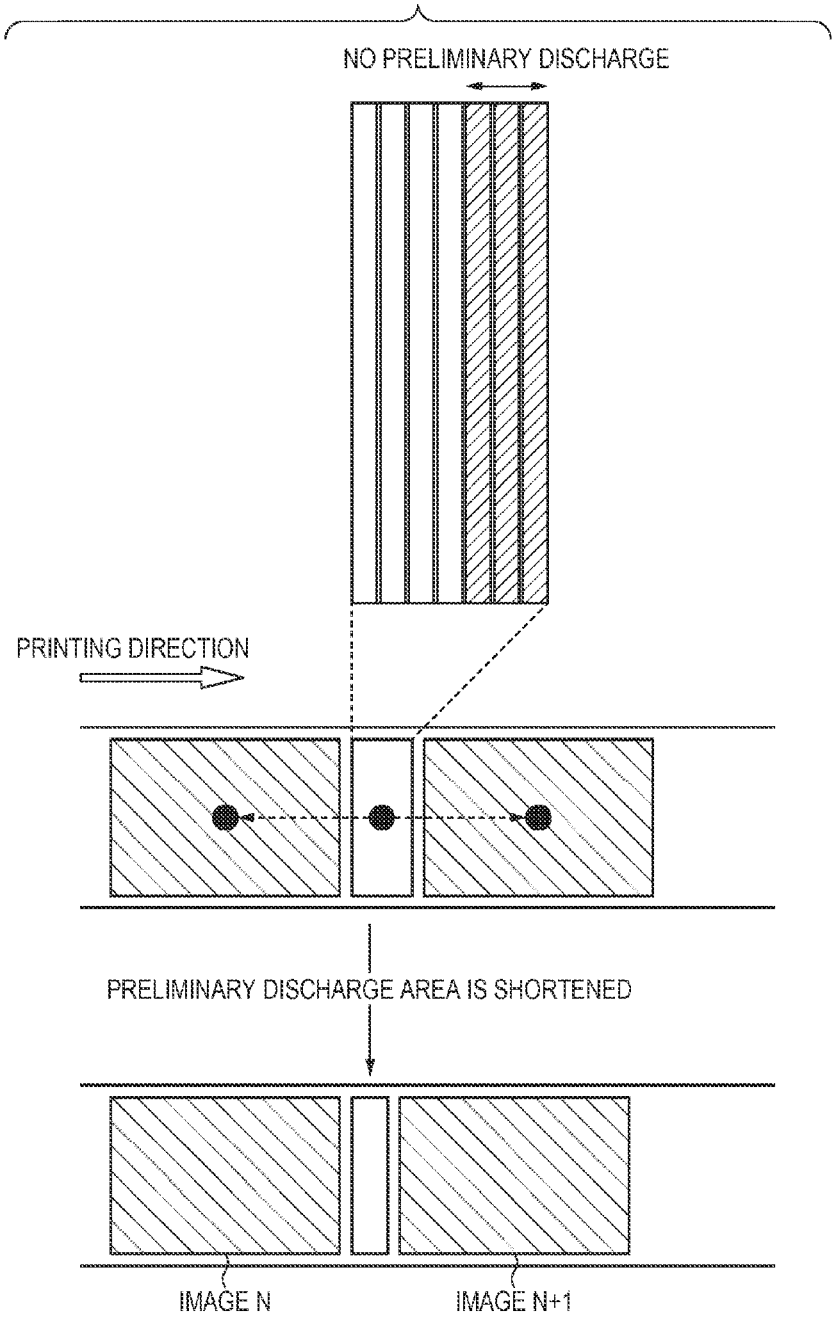
FIG. 16 is a view showing an image layout when preliminary discharge is unnecessary for some printheads which perform discharge, as a result of determining whether preliminary discharge is necessary or unnecessary.

FIG. 16 is a view showing an image layout when preliminary discharge is unnecessary for some printheads which perform discharge, as a result of determining whether preliminary discharge is necessary or unnecessary.

As shown in FIG. 16, in some cases, it is determined that preliminary discharge for the preliminary discharge pattern is unnecessary between the images N and N+1 for, for example, all the nozzles of three printheads out of seven full-line printheads, and it is unnecessary to execute preliminary discharge. In this case, the area of the preliminary discharge pattern can be decreased by three lines. As a result, the print start position of the subsequent image N+1 can be moved forward in the sheet conveyance direction.

Figure 17:
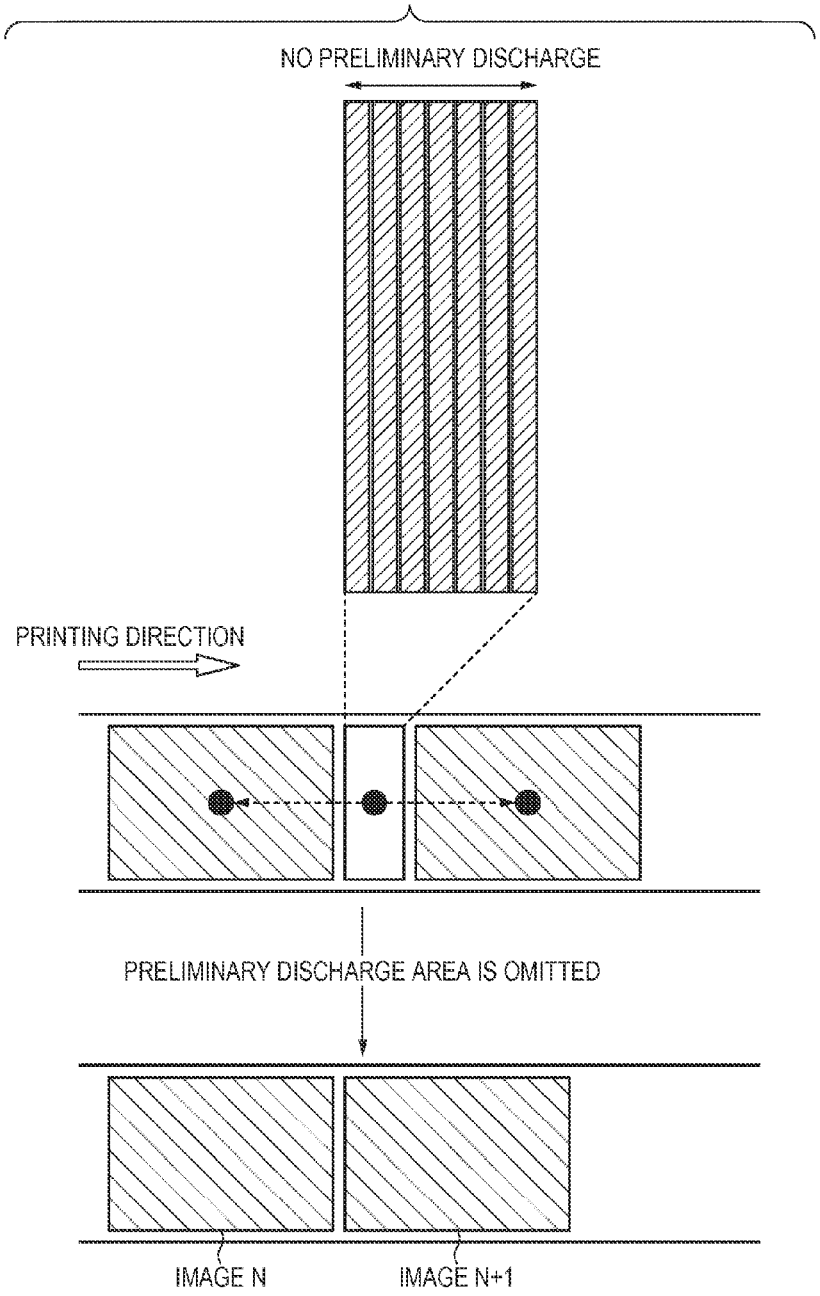
FIG. 17 is a view showing an image layout when preliminary discharge is unnecessary for all printheads which perform discharge, as a result of determining whether preliminary discharge is necessary or unnecessary.

FIG. 17 is a view showing an image layout when, as a result of determining whether preliminary discharge is necessary or unnecessary, it is determined that preliminary discharge is unnecessary for all the nozzles of all the printheads which perform discharge, and preliminary discharge from all the printheads becomes unnecessary. As shown in FIG. 17, the preliminary discharge pattern is omitted when, for example, all the seven full-line printheads do not require preliminary discharge for the preliminary discharge pattern between the images N and N+1. The subsequent image N+1 can therefore be printed successively to the image N. That is, when it is determined that preliminary discharge is unnecessary for all the nozzles of one printhead, the preliminary discharge pattern of the printhead can be omitted.

Figure 18:
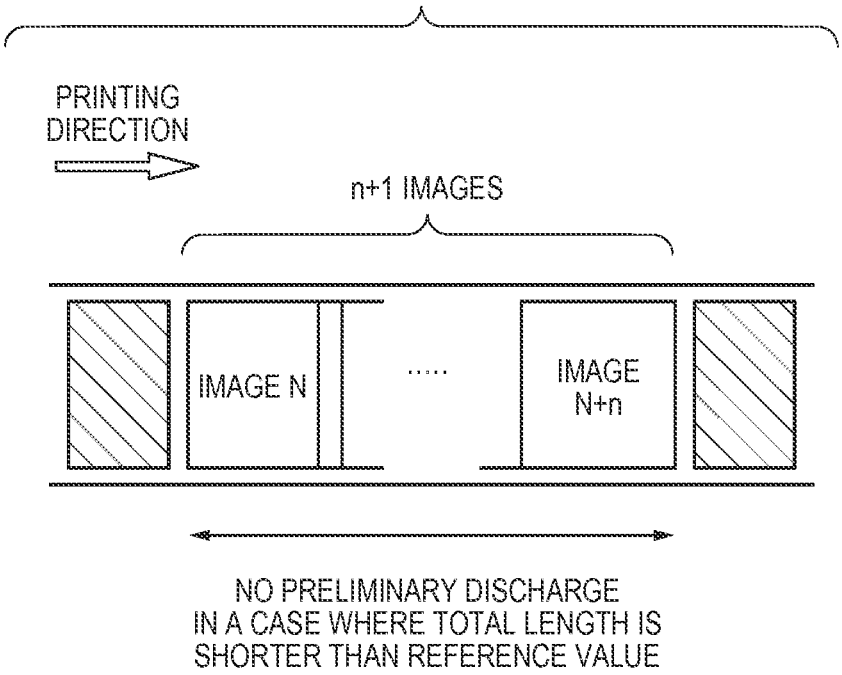
FIG. 18 is a view showing an image layout when the total length from an image N to image N+n in the printing direction is shorter than a reference value used for determining whether preliminary discharge is necessary or unnecessary.

FIG. 18 is a view showing an image layout when the total length till the end of an image N+n in the printing direction is shorter than the reference value for determining whether preliminary discharge is necessary or unnecessary in all the printheads. In this case, the images from image N to image N+n are successively printed from all the printheads without preliminary discharge, as shown in FIG. 18. Accordingly, the n+1 images can be printed successively.

By the processing described with reference to FIGS. 8 to 18, whether preliminary discharge is necessary or unnecessary is determined for each nozzle in step S603 of FIG. 7. Thus, minimum discharge is realized.

Although the determination is made for each nozzle of the printhead in this embodiment, it may be made for each nozzle block. When it is determined that printing of the preliminary discharge pattern can be omitted after printing the image N, as shown in FIG. 17 or 18, the process in FIG. 7 advances from step S603 to step S605. In the case illustrated in FIG. 16, or a case where none of the cases in FIGS. 16 to 18 holds and preliminary discharge cannot be omitted for each line, the process in FIG. 7 advances from step S603 to step S604.

Finally, details of step S604 will be explained.

Figure 19:
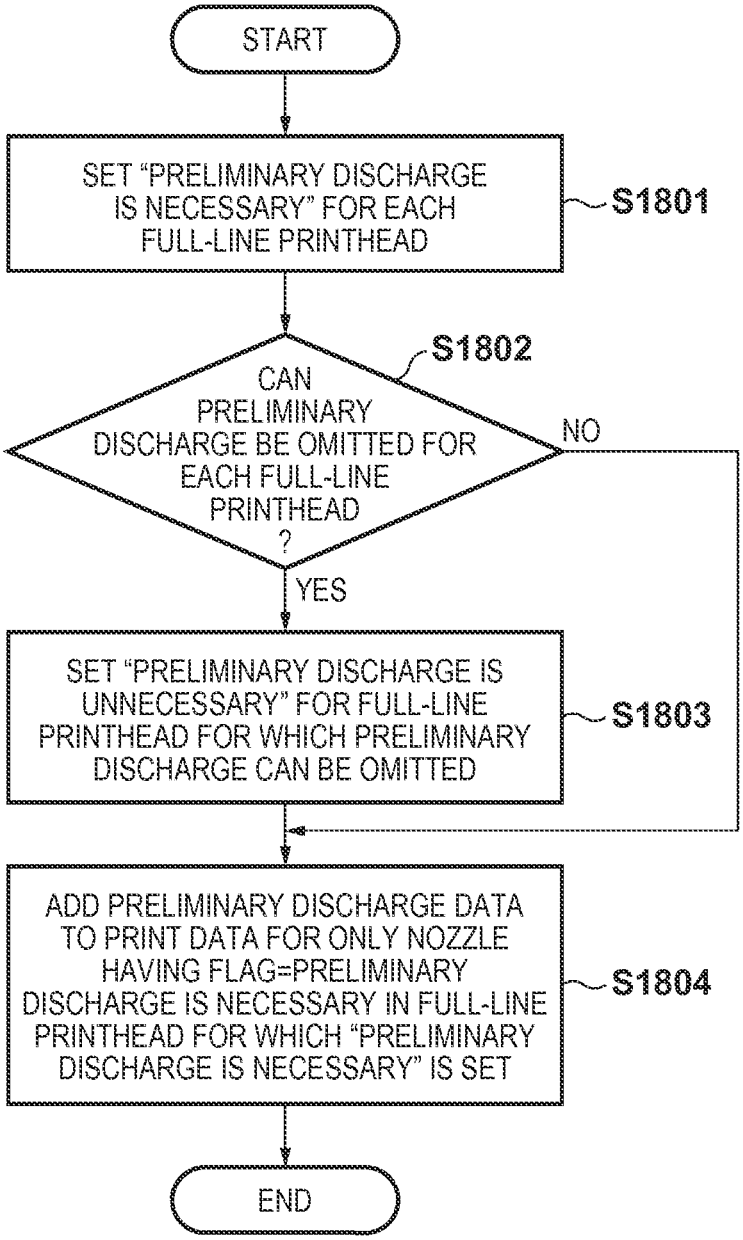
FIG. 19 is a flowchart showing details of step S604 in FIG. 7.

FIG. 19 is a flowchart showing details of step S604.

First, in step S1801, a flag representing "preliminary discharge is necessary" is set for all the full-line printheads.

Then, in step S1802, it is checked whether or not there is a full-line printhead for which preliminary discharge can be omitted. If it is determined by the method described with reference to FIG. 16 that preliminary discharge can be omitted for all the nozzles of one full-line printhead, the process advances to step S1803. In contrast, if it is determined by the method described with reference to FIG. 16 that preliminary discharge cannot be omitted for all the nozzles of one full-line printhead, the process advances to step S1804.

In step S1803, the setting is changed to a flag representing "preliminary discharge is unnecessary" for the full-line printhead for which preliminary discharge can be omitted. The process then advances to step S1804. In step S1804, preliminary discharge data is generated for only nozzles for which it is determined in preliminary discharge necessity/unnecessity determination that preliminary discharge is necessary, in the full-line printhead for which "preliminary discharge is necessary" is set in the flag. The preliminary discharge data is added to print data. By printing the preliminary discharge pattern using only nozzles requiring preliminary discharge, the ink consumption can be reduced. By this processing, print data is generated by adding data of the preliminary discharge pattern after image data of the image N.

When it is determined that preliminary discharge is necessary for one nozzle of one full-line printhead, print data may be generated to print the preliminary discharge pattern from all the nozzles of the full-line printhead. This is because printing from all the nozzles may cause omitting the next preliminary discharge pattern for this full-line printhead.

According to the above-described embodiment, when a plurality of images of different sizes are printed by the full-line printhead, the image quality maintenance pattern can be printed in only a minimum area. Therefore, while the throughput is increased, the image quality can be maintained.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-229240, filed Oct. 16, 2012, which is hereby incorporated by reference herein in its entirety.

What is claimed is:

1. A print control method in a printing apparatus which prints a plurality of images by using a full-line printhead having a plurality of nozzles which discharge ink to a sheet, comprising:

inputting image data from a host apparatus;

calculating, for each of the plurality of nozzles, a time between a time of final ink discharge when an Nth image has been printed and a time of initial ink discharge when printing an (N+1)th image following the Nth image;

determining, based on the calculated time, whether or not to perform preliminary discharge for each of the plurality of nozzles; and performing preliminary discharge between the Nth image and the (N+1)th image from the nozzles determined to be used for the preliminary discharge.

2. A printing apparatus comprising:

a full-line printhead having a plurality of nozzles for discharging ink to a sheet;

an input unit configured to input image data from a host apparatus;

a calculation unit configured to calculate, for each of the plurality of nozzles, a time between a time of final ink discharge when an Nth image has been printed on the sheet and a time of initial ink discharge when printing an (N+1)th image following the Nth image on the sheet;

a determination unit configured to determine, based on the time calculated by said calculation unit, whether or not to perform preliminary discharge for each of the plurality of nozzles; and a preliminary discharge unit configured to perform preliminary discharge between the Nth image and the (N+1) th image from the nozzles determined by the determination unit to be used for the preliminary discharge.

3. The apparatus according to claim 2, wherein the time can be obtained from a length between pixels for which ink is discharged.

4. The apparatus according to claim 2, wherein in a case where the time is shorter than a predetermined time, said determination unit analyzes a time during which no ink is discharged in successive images, and said determination unit further compares the time obtained as a result of the analysis with the predetermined time.

5. The apparatus according to claim 4, wherein said determination unit performs analysis, including a time for preliminary discharge between successive images.

6. The apparatus according to claim 2, wherein in a case where said determination unit determines that the preliminary discharge is unnecessary for all the nozzles included in the full-line printhead, an interval between a plurality of images is shortened by shortening or omitting an area of the sheet necessary for the preliminary discharge, and then the plurality of images are printed.

7. The apparatus according to claim 2, wherein in a case where the time calculated by said calculation unit is longer than a predetermined time, said determination unit determines that the preliminary discharge is to be performed.

8. The apparatus according to claim 2, wherein the full-line printhead includes a plurality of full-line printheads, and the plurality of full-line printheads discharge inks of different colors.

* * * * *